US005885678A

United States Patent [19]

Malhotra

[11] Patent Number: 5,885,678

[45] Date of Patent: Mar. 23, 1999

[54] COATED LABELS

[75] Inventor: Shadi L. Malhotra, Mississauga, Canada

[73] Assignee: Xerox Corporation, Stamford, Conn.

[21] Appl. No.: 657,234

[22] Filed: Jun. 3, 1996

[51] Int. Cl.[6] ..... B41M 5/00

[52] U.S. Cl. ..... 428/41.8; 428/195; 428/500; 428/532; 428/914

[58] Field of Search ..... 428/40.1, 152, 428/195, 480, 532, 500, 447, 41.8, 343, 352, 354, 914

[56] References Cited

U.S. PATENT DOCUMENTS

| | | | |
|---|---|---|---|
| 5,096,781 | 3/1992 | Vieira et al. | 428/195 |
| 5,223,338 | 6/1993 | Malhotra | 428/342 |
| 5,378,758 | 1/1995 | Amici et al. | 525/57 |
| 5,413,840 | 5/1995 | Mizuno | 428/195 |
| 5,418,208 | 5/1995 | Takeda et al. | 503/227 |
| 5,472,757 | 12/1995 | Ogawa et al. | 428/40 |
| 5,670,226 | 9/1997 | Yoshizawa et al. | 428/40.1 |

*Primary Examiner*—Pamela R. Schwartz
*Attorney, Agent, or Firm*—E. O. Palazzo

[57] ABSTRACT

Printable ink jet laminateable labels comprised of (1) a substrate; (2) a first ink receiving coating on the front side of the substrate capable of absorbing an ink vehicle, and which receiving layer coating is comprised of (a) a hydrophilic binder polymer, (b) an ink spreading agent, (c) a dye mordant, (d) a lightfastness inducing agent or component, (e) an optional biocide, (f) an optional filler, and (h) an optional latex binder; (3) a second heat and pressure sensitive adhesive coating in contact with the back, or reverse of the front side of the substrate, and which adhesive is comprised of a polymer with a glass transition temperature of from between about a negative −100° C. to about 25° C.; and (4) a peelable release paper covering the adhesive coated side of the label, which release paper is coated with a release polymer.

14 Claims, No Drawings

COATED LABELS

BACKGROUND OF THE INVENTION

Uncoated labels printed with ink jet inks and adhered to paper, cloth and plastic surfaces, such as spines and covers of books and magazines, may not be adequate primarily since the images on the uncoated labels are not resistant to water, or possess minimal resistance to water. Furthermore, the copy quality of the ink jet images, and xerographic images on the uncoated labels needs improvement. The present invention overcomes these and other disadvantages, and in embodiments is directed to ink jet and xerographically writeable labels capable of receiving images from liquid inks and solid ink compositions used in various ink jet and xerographic printing processes, and which inks can be affixed to spines and covers of books and magazines. More specifically, the present invention in embodiments is directed to obtaining images of an optical density between about 1.5 to 2.0 for the black ink, between about 1.2 to 1.6 for the cyan ink, between about 1.1 to 1.4 for the magenta ink, and between about 0.85 to 1.0 for the yellow ink, with lightfastness values of greater than or equal to about 95 percent for all inks, waterfastness values greater than or equal to about 90 percent for all inks, and low edge raggedness values of about 0.25 millimeter (between black and yellow), about 0.30 millimeter (between cyan and yellow), 0.30 millimeter (between magenta and yellow), and about 0.45 millimeter (between magenta and cyan) on ink jet writeable labels, and labels that can be used in xerographic applications, which labels can be prepared from coated recording labels containing an ink receiving layer on the front of the first side of the label and a book spine and book cover compatible heat and pressure sensitive adhesive on the second or reverse back side of the label, and a peelable release paper covering the adhesive coated side of the label, which release paper is removed from the label prior to affixing the label to the book spine and book cover by the application of low heat and pressure. One embodiment of the present invention is directed to ink jet printable laminateable labels for book spines and book covers comprised of (a) a substrate such as paper, polyvinylchloride (vinyl), opaque MYLAR®, transparent MYLAR®, polypropylene, Teslin, and the like, (1) a first ink receiving coating on the front side of the substrate label capable of absorbing the ink vehicle and comprised of a polymer, such as polyvinylpyrrolidone, polyvinylalcohol and the like, or mixtures thereof, an ink spreading agent such as poly(alkylene oxide), a dye mordant such as a quaternary compound, a lightfastness inducing agent such as 1,2-hydroxy-4-(octyloxy)benzophenone, 2-(4-benzoyl-3-hydroxyphenoxy) ethylacrylate, and the like, an optional biocide like 2-hydroxypropylmethane thiosulfonate, a filler such as colloidal silica; (2) a second book spine and book cover compatible pressure sensitive adhesive coating in contact with the back, or reverse side of the substrate label and comprised of at least one material selected from the group consisting of polymers having a glass transition temperature of between a negative −100° C. to about a positive 25° C., such as polyvinylmethyl ether, polyethylacrylate, and the like; and (3) a peelable release paper covering the adhesive coated side of the label, which release paper is coated with a release material, such as a wax, and the like, (b) imaging the ink receiving layer with a liquid method such as ink jet, and (c) peeling the release paper covering the adhesive coated side of the label and affixing these labels at a temperature of about 25° C. to about 50° C. and a pressure of about 25 psi to about 125 psi to a spine and cover of a book, including manuals, using a hot roller.

In another embodiment, the present invention is directed to a xerographically printable laminateable label for paper, cloth and plastic surfaces of books and magazines, which labels are comprised of (a) a substrate such as paper, polyvinylchloride (vinyl), opaque MYLAR®, transparent MYLAR®, polypropylene, Teslin and the like, (1) a first toner receiving coating on the front side of the substrate label capable of wetting the surface of the toner and comprised of a polymer such as ethyl cellulose, cyanoethylated cellulose, and the like, or mixtures thereof, a toner spreading agent, such as poly(alkylene oxide), an antistatic agent, such as a quaternary compound, a lightfastness inducing agent, such as 1,2-hydroxy-4-(octyloxy)benzophenone, 2-(4-benzoyl-3-hydroxyphenoxy) ethylacrylate and the like, an optional biocide, 2-hydroxypropylmethane thiosulfonate, a filler such as colloidal silica, and (2) a second book spine and book cover compatible heat and pressure sensitive adhesive coating in contact with the back side of the label substrate and comprised of at least one material selected from the group consisting of polymers having a glass transition temperature of between about −100° C. to about 25° C., such as polyvinylmethyl ether, polyethylacrylate and the like, and a peelable release paper covering the adhesive coated side of the label, which release paper is coated with a release polymer such as a wax and the like; (b) imaging the toner receiving layer with a marking process using solid inks, or toners of resin and pigments, such as xerography; and (c) peeling the release paper covering the adhesive coated side of the label and affixing these labels at a temperature of about 25° C. to about 50° C. and a pressure of about 25 psi to about 125 psi to the spine and cover of the book using a hot roller.

Protective sheets used in various printing and imaging processes are known. For example, U.S. Pat. No. 5,418,208 discloses a laminated plastic card providing a lamination of a dye accepting layer, a substrate of paper or the like, and a back coat layer on the lamination one or more patterns are printed with a volatile dye, and a transparent plastic film adhered on the lamination by an adhesive agent, wherein the adhesive agent is a saturated polyester having an average molecular weight of 18,000 grams/mole and produced by condensation polymerization of polypropylene glycol or trimethylol propane and adipic acid or azelaic acid.

U.S. Pat. No. 5,413,840 discloses a decorative laminated sheet with improved surface hardness, which sheet is produced by laminating a polyester film excellent in transparency on the surface of a semi-rigid thermoplastic resin film supplied with a colored layer or a pattern-printed layer, and then coating a hard coat layer comprising a UV-curable coating on the surface of the polyester film of the resulting laminated film.

U.S. Pat. No. 5,382,615 discloses hot-melt adhesive compositions useful for packaging. These hot-melt adhesive compositions are based on modified polyethylene and contain an ethylene-alkylacrylate copolymer, a polyethylene graft copolymer, a tackifying resin, and a high-melting low viscosity wax. The hot-melt adhesive compositions disclosed apparently possess fast setting times.

U.S. Pat. No. 5,378,758 discloses a hot-melt adhesive composition where polymers containing a high percentage of vinyl alcohol units may be blended with copolymers of alkylmethacrylate and unsaturated acids, the copolymers preferably containing an adhesion-promoting functionality, the blend preferably containing low levels of a plasticizer to improve melt flow, and the blends in molten form utilized as hot melt adhesives for the bonding of wood, paper, and other cellulosic articles.

U.S. Pat. No. 5,378,536 discloses a repositionable adhesive tape where an adhesive of certain elastomeric block copolymers and tackifying materials can be hot-melt coated on to a flexible backing to provide an adhesive tape, two pieces of which can bond to each other for excellent resistance to shear forces, and that apparently can be easily peeled apart, even after prolonged periods of time. The adhesive can be low-tack or tack-free. When the adhesive is tacky, it can bind sheets into a note pad from which individual sheets can be removed, and temporarily adhered to paper and other substrates.

U.S. Pat. No. 5,352,530 discloses a highly transparent film having high strength, suitable extensibility, high weather resistance, and low moisture absorption, which consists mainly of ethylene-vinylacetate copolymer.

U.S. Pat. No. 5,346,766 discloses a positionable-repositionable pressure sensitive adhesive that may be repeatedly applied to a surface and removed during an initial installation time period. The adhesive contains an adhesive base resin and coacting detackifying resin, and particulate components which temporarily reduce the tack and peel strength of the adhesive.

U.S. Pat. No. 5,342,685 discloses a hot melt coatable pressure-sensitive adhesive with high levels of adhesion to low surface energy films. The adhesive elastomeric phase comprises from 78 to 98 parts by weight of a diblock A-B type block copolymer with an elastomeric block of 1,3-polybutadiene with 2 to 22 parts by weight of multiblock A-B type block copolymer. The tackifying material comprises 140 parts or less of a solid tackifying resin and a liquid tackifier to provide an adhesive having a composite mid-block glass transition of −10° C.

U.S. Pat. No. 5,322,876 discloses that the cuttability of elastomeric pressure-sensitive adhesives, particularly of the hot-melt tackified mutually immiscible elastomers, is improved by the addition of surfactants containing polyethylene oxide and polypropylene oxide blocks.

Xerographic transparencies useful in printing and copying processes wherein dry or liquid electrophotographic-type developers are employed, such as electrophotographic processes, are known as described in, for example, U.S. Pat. No. 2,297,691 to Chester Carlson. Ionographic and electrographic processes are also known, and are described in, for example, U.S. Pat. No. 3,564,556, U.S. Pat. No. 3,611,419, U.S. Pat. No. 4,240,084, U.S. Pat. No. 4,569,584, U.S. Pat. No. 2,919,171, U.S. Pat. No. 4,524,371, U.S. Pat. No. 4,619,515, U.S. Pat. No. 4,463,363, U.S. Pat. No. 4,254,424, U.S. Pat. No. 4,538,163, U.S. Pat. No. 4,409,604, U.S. Pat. No. 4,408,214, U.S. Pat. No. 4,365,549, U.S. Pat. No. 4,267,556, U.S. Pat. No. 4,160,257, and U.S. Pat. No. 4,155,093, the disclosures of each of which are totally incorporated herein by reference. The ionographic process involves generating an electrostatic latent image on an imaging member in an imaging apparatus; developing the latent image with a toner; transferring the developed image to a transparency and optionally permanently affixing the transferred image.

Ink jet transparencies and papers used in various printing and imaging processes are known, reference for example, U.S. Pat. No. 4,601,777, U.S. Pat. No. 4,251,824, U.S. Pat. No. 4,410,899, U.S. Pat. No. 4,412,224, and U.S. Pat. No. 4,532,530, the disclosures of each of which are totally incorporated herein by reference. U.S. Pat. No. 5,223,338 the disclosure of which is totally incorporated herein by reference, discloses a recording sheet which comprises a substrate and a coating consisting essentially of quaternary ammonium polymers.

U.S. Pat. No. 5,314,747, the disclosure of which is totally incorporated herein by reference, discloses a recording sheet which comprises (a) a base sheet; (b) a cationic sulfur compound selected from the group consisting of sulfonium compounds, thiazolium compounds, benzothiazolium compounds, and mixtures thereof; (c) an optional binder; and (d) an optional pigment.

U.S. Pat. No. 5,441,795, the disclosure of which is totally incorporated herein by reference, discloses a recording sheet which comprises a base sheet and a material selected from the group consisting of pyridinium compounds, piperazinium compounds, and mixtures thereof.

U.S. Pat. No. 5,320,902, the disclosure of which is totally incorporated herein by reference, discloses a recording sheet of a substrate and, in contact with the substrate, a monoammonium compound.

U.S. Pat. No. 5,457,486, the disclosure of which is totally incorporated herein by reference, discloses a recording sheet which comprises (a) a base sheet; (b) a material selected from the group consisting of tetrazolium compounds, indolinium compounds, imidazolinium compounds, and mixtures thereof; (c) an optional pigment; and (d) an optional binder.

U.S. Pat. No. 5,663,004, the disclosure of which is totally incorporated herein by reference, discloses a recording sheet which comprises a substrate, an image receiving coating, and a biocide.

While known laminated structures are suitable for their intended purposes, a need remains for improved laminated structures with improved printable laminateable labels for book spines. In addition, there is a need for improved coated printable laminateable labels for book spines which can be laminated by the application of low heat and low pressure to the uneven surface of the book spines. Further, a need remains for printable laminateable labels for book spines for ink jet printing wherein images on the spine exhibit reduced curl and a high degree of light and waterfastness. Additionally, there is a need for printable laminateable labels for book spines for ink jet printing with enhanced optical density. Further, there is a need for printable laminateable tapes for book spines for electrostatic printing processes, such as electrophotography, which exhibit excellent toner fix of the image to the sheet. Additionally, there is a need for printable laminateable tapes for book spines suitable for both ink jet printing processes and electrostatic printing processes, which tapes exhibit reduced curl and high optical density when used for ink jet printing and which exhibit reduced curl and excellent toner fix when selected for electrostatic printing.

SUMMARY OF THE INVENTION

Examples of objects of the present invention include:

It is an object of the present invention to provide printable laminateable labels for book spines and book covers to achieve the advantages illustrated herein.

It is another object of the present invention to provide improved printable laminateable labels for book spines and book covers suitable for use in both ink jet printing processes and electrostatic printing processes.

It is yet another object of the present invention to provide improved coated printable laminateable labels for book spines and book covers which can be laminated by the application of low heat and pressure to the uneven surfaces of the book spines, and moreover to ink jet printable labels obtained from recording vinyl labels containing an ink receiving layer on the front side and a compatible heat adhesive layer on the reverse side of the label, and a release paper thereover.

It is still another object of the present invention to provide printable laminateable labels for book spines and book covers for ink jet printing wherein images on the spine exhibit reduced curl and excellent light and waterfastness.

Another object of the present invention is to provide printable laminateable labels for book spines and book covers for ink jet printing with enhanced optical density.

Still another object of the present invention is to provide printable laminateable labels for book spines and book covers for electrostatic printing processes, such as electrophotography which labels exhibit excellent toner fix of the image to the sheet.

It is another object of the present invention to provide printable laminateable labels for book spines suitable for both ink jet printing processes and electrostatic printing processes which labels exhibit images with high gloss, high optical density, improved lightfastness and waterfastness when used for ink jet printing, and which labels exhibit reduced curl, excellent toner fix, high gloss and minimum scratching and scuffing of the images when used for electrostatic printing. Both ink jet printer labels and xerographic labels are provided in embodiments of the present invention.

These and other objects of the present invention in embodiments thereof can be achieved by providing a substrate, such as paper, polyvinylchloride (vinyl), opaque MYLAR® barium sulfate, and titanium dioxide filled polyethylene terephthalate, a transparent MYLAR®, polypropylene, Teslin, a filled polypropylene with micro voids and the like, (1) a first ink receiving coating on the front side of the substrate label capable of absorbing an ink vehicle, and which coating is comprised of a polymer, such as polyvinylpyrrolidone, polyvinylalcohol and the like, or mixtures thereof, an ink spreading agent such as poly (alkylene oxide), a dye mordant such as a quaternary compound, a lightfastness inducing agent, such as 1,2-hydroxy-4-(octyloxy)benzophenone, 2-(4-benzoyl-3-hydroxyphenoxy) ethylacrylate and the like, an optional biocide like 2-hydroxypropylmethane thiosulfonate, an optional filler such as colloidal silica, an optional latex binder such as an acrylic latex binder, and (2) a second book spine and book cover compatible pressure sensitive adhesive coating in contact with the back side of the substrate label and comprised of at least one material selected from the group consisting of polymers having a glass transition temperature of between from about −100° C. to about 25° C. such as polyvinylmethyl ether, polyethylacrylate and the like; and (3) a peelable release paper covering the adhesive coated side of the label, which release paper is coated with a release material such as a wax and the like. The ink receiving layer of the label can be imaged with a liquid marking process, such as ink jet; followed by peeling the release paper covering the adhesive coated side of the label and affixing the label at a temperature of about 25° C. to about 50° C. and a pressure of about 25 psi to about 125 psi to the spine and cover of a book using a hot roller at a temperature, for example, of about 50° C.

Another embodiment of the present invention is directed to a xerographically printable laminateable label for book spines and book covers comprised of (a) a substrate, such as paper, polyvinylchloride (vinyl), opaque MYLAR®, transparent MYLAR®, polypropylene, TESLIN™ and the like, (1) a first toner receiving coating on the front side of the label substrate capable of wetting the surface of the toner and comprised of a polymer such as ethyl cellulose, cyanoethylated cellulose, and the like, or mixtures thereof, a toner spreading agent, such as poly(alkylene oxide), an antistatic agent, such as a quaternary compound, a lightfastness inducing agent, such as 1,2-hydroxy-4-(octyloxy)benzophenone, 2-(4-benzoyl-3-hydroxyphenoxy) ethylacrylate and the like, an optional biocide, 2-hydroxypropylmethane thiosulfonate, a filler, such as colloidal silica, an optional latex binder, such as an acrylic latex binder; and (2) a second book spine and book cover compatible heat and pressure sensitive adhesive coating in contact with the back side of the label substrate and comprised of at least one polymer having a glass transition temperature of between −100° C. to about 25° C. such as polyvinylmethyl ether, polyethylacrylate, and the like, and a peelable release paper covering the adhesive coated side of the label, which release paper is coated with a release polymer such as a wax-like polypropylene, and the like; (b) imaging the toner receiving layer with a marking method using solid toners, such as xerography; and (c) peeling the release paper covering the adhesive coated side of the label and affixing these labels at a temperature of about 25° C. to about 50° C. and a pressure of about 25 psi to about 125 psi to the spine and cover of the book using a hot roller. The substrate (1) is situated between the first ink coating layer (2), and the second heat pressure adhesive coating (3).

DETAILED DESCRIPTION OF THE INVENTION

The coated sheets of the present invention comprise in embodiments a substrate or base sheet having a coating on both lateral surfaces thereof. Any suitable substrate can be employed, illustrative examples of which include surface sized papers, Diazo papers, offset papers, such as Great Lakes offset, recycled papers, such as Conservatree, office papers, such as Automimeo, Eddy liquid toner paper and copy papers available from companies, such as Nekoosa, Champion, Wiggins Teape, Kymmene, Modo, Domtar, Veitsiluoto, Sanyo, and coated base papers available from sources such as Scholler Technical Papers, Inc. and the like. Examples of substrate materials include polyesters, including MYLAR™, a polyethylene terephthalate available from E. I. DuPont de Nemours & Company, MELINEX™, polyethylene terephthalate available from Imperial Chemicals, Inc., CELANAR™, polyethylene terephthalate available from Celanese Corporation, polyethylene naphthalates, such as Kaladex PEN films, available from Imperial Chemical Industries, polycarbonates, such as LEXAN™, available from General Electric Company, polysulfones, such as those available from Union Carbide Corporation, polyether sulfones, UDEL™, available from Union Carbide Corporation, polyether sulfones, VICTREX™, available from ICI Americas Incorporated, poly(arylene sulfones), cellulose triacetate, polyvinylchloride, cellophane, polyvinyl fluoride, polyimides, and the like, with polyester, such as MYLAR™, being preferred primarily because of its availability and relatively low cost. The substrate can also be opaque, including opaque MYLARS™ which are barium sulfate and titanium dioxide filled polyethylene terephthalate, such as TESLIN™ which is filled polypropylene with micro voids available from PPG Industries. Filled plastics can also be employed as the substrate, particularly when it is desired to generate a "never-tear paper" recording sheet.

The first ink receiving layer coating composition capable of receiving images from an ink jet printer is present on the front, or first side of the substrate of the coated printable laminateable labels of the present invention in various effective thicknesses. Typically, the total thickness of this coating layer is from about 0.1 to about 25 microns and preferably from about 0.5 to 10 microns, although the thickness can be outside of these ranges. In the first coating composition, the binder can be present within the coating in various effective amounts, for example in a total of 100 parts by weight, the binder or mixture thereof are present in amounts of from about 5 parts by weight to about 45 parts by weight, the ink spreading agent such as poly(alkylene oxide), homologs and copolymers thereof are present in the first layer coating composition in amounts of, for example, from about 45 parts by weight to about 1 part by weight, the dye mordant or mixture thereof is present in the first coating composition, in amounts of from about 33 parts by weight to about 2 parts by weight, the lightfastness inducing compounds or mixture thereof are present in the first coating composition, in amounts of from about 12 parts by weight to about 1 part by weight, the fillers of the first layer coating composition are present in amounts of from about 1 part by weight to about 50 parts by weight, the biocides of the first layer coating composition are present in amounts of from about 4 parts by weight to about 1 part by weight. The aforementioned amounts represent examples of amounts, and other amounts may be selected in embodiments of the present invention.

The aforementioned amounts can be determined by a number of known methods and, for example, as follows:

Various blends of the binder, the ink spreading agent, dye mordants, lightfastness inducing agent, fillers, and the biocide were prepared in water and coated on to various base sheets, such as paper, TESLIN™ and opaque MYLAR®, to yield coated labels with a single layer thereover and thereunder. After drying the base sheets at 100° C., these were tested for coating adhesion to the base sheet, printed with a Xerox Corporation ink jet test fixture to, for example, check print quality, drying times of the images, lightfastness and intercolor bleed. The data was analyzed statistically for optimum range of compositions. A preferred composition range for the first layer coating of the coated label is the binder present in amounts of from about 10 parts by weight to about 40 parts by weight, the ink spreading agent present in an amount of from about 40 parts by weight to about 4 parts by weight, the dye mordants present in an amount of from about 30 parts by weight to about 3 parts by weight, the lightfastness inducing agent or mixtures thereof present in amounts of from about 10 parts by weight to about 2 parts by weight, the fillers present in amounts of from about 7 parts by weight to about 50 parts by weight, and the biocide compounds or mixtures thereof present in amounts of from about 3 parts by weight to about 1 part by weight based on 100 total parts (10+40+30+10+7+3) to (40+4+3+2+50+1).

Examples of suitable ink jet and xerographically writeable hydrophilic binder polymers of the first layer coating composition present on the front side of the substrate include (a) hydrophilic polysaccharides and their modifications, such as (1) starch, such as starch SLS-280, available from St. Lawrence Starch; (2) cationic starch, such as Cato-72, available from National Starch; (3) hydroxyalkyl starch, wherein alkyl has at least one carbon atom, and wherein the number of carbon atoms is such that the material is water soluble, preferably from about 1 to about 20 carbon atoms, and more preferably from about 1 to about 10 carbon atoms, such as methyl, ethyl, propyl, butyl, or the like, such as hydroxypropyl starch (#02382, available from Poly Sciences Inc.) and hydroxyethyl starch (#06733, available from Poly Sciences Inc.); (4) gelatin, such as Calfskin gelatin (#00639, available from Poly Sciences Inc.); (5) alkyl celluloses and aryl celluloses, wherein alkyl has at least one carbon atom, and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like, such as methyl cellulose (Methocel AM 4, available from Dow Chemical Company), and wherein aryl has at least 6 carbon atoms, and wherein the number of carbon atoms is such that the material is water soluble, preferably from 6 to about 20 carbon atoms, more preferably from 6 to about 10 carbon atoms, and even more preferably about 6 carbon atoms, such as phenyl; (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like, such as hydroxyethyl cellulose (Natrosol 250 LR, available from Hercules Chemical Company), and hydroxypropyl cellulose (Klucel Type E, available from Hercules Chemical Company); (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like, such as ethyl hydroxyethyl cellulose (Bermocoll, available from Berol Kem. A.B. Sweden); (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as hydroxyethyl methyl cellulose (HEM, available from British Celanese Ltd., also available as Tylose MH, MHK from Kalle A.G.), hydroxypropyl methyl cellulose (Methocel K35LV, available from Dow Chemical Company), and hydroxy butylmethyl cellulose, such as HBMC, available from Dow Chemical Company); (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as dihydroxypropyl cellulose, which can be prepared by the reaction of 3-chloro-1,2-propane with alkali cellulose; (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as hydroxypropyl hydroxyethyl cellulose, available from Aqualon Company; (11) halodeoxycellulose, wherein halo represents a halogen atom, such as chlorodeoxycellulose, which can be prepared by the reaction of cellulose with sulfuryl chloride in pyridine at 25° C.; (12) amino deoxycellulose, which can be prepared by the reaction of chlorodeoxy cellulose with 19 percent alcoholic solution of ammonia for 6 hours at 160° C.; (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom, such as diethylammonium chloride hydroxy ethyl cellulose (available as Celquat H-100, L-200, National Starch and Chemical Company); (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom, such as hydroxypropyl trimethyl ammonium chloride hydroxyethyl cellulose (available from Union Carbide Company as Polymer JR); (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as diethyl amino ethyl cellulose (available from Poly Sciences Inc. as DEAE cellulose #05178); (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, such as carboxymethyl dextrans (available from Poly Sciences Inc. as #16058); (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as diethyl aminoethyl dextran (available from Poly Sciences Inc. as #5178); (18) amino dextran (available from Molecular Probes Inc.); (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethyl cellulose CMC 7HOF, available from Hercules Chemical Company); (20) gum arabic (such as #G9752, available from Sigma Chemical Company); (21) carrageenan (such as #C1013 available from Sigma Chemical Company); (22) Karaya gum (such as #G0503, available from Sigma Chemical Company); (23) xanthan (such as Keltrol-T, available from Kelco division of Merck and Company); (24) chitosan (such as #C3646, available from Sigma Chemical Company); (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as carboxymethyl hydroxypropyl guar, available from Auqualon Company); (26) cationic guar (such as Celanese Jaguars C-14-S, C-15, C-17, available from Celanese Chemical Company); (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin; (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein, available from Croda as Croquats); (29) agar-agar (such as that available from Pfaltz and Bauer Inc.); (30) cellulose sulfate salts, wherein the cation is any conventional cation, such as sodium, lithium, potassium, calcium, magnesium, or the like (such as sodium cellulose sulfate #023 available from Scientific Polymer Products); and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethylhydroxyethyl cellulose CMHEC 43H and 37L available from Hercules Chemical Company); (b) vinyl polymers, such as (1) poly(vinyl alcohol) (such as Elvanol available from E. I. DuPont Chemical Company); (2) poly (vinyl phosphate) (such as #4391 available from Poly Sciences Inc.); (3) poly(vinyl pyrrolidone) (such as those PVP K-15, PVP K-30, PVP K-60, PVP K-90, IGUAFEN A, PLASDONE K-25, PLASDONE K-26/28, PLASDONE K-29/32, PLASDONE C-15, PLASDONE C-30, PLASDONE XL, available from GAF Corporation); (4) vinyl pyrrolidone-vinyl acetate copolymers (such as #02587, available from Poly Sciences Inc.); (5) vinyl pyrrolidone-styrene copolymers (such as #371, available from Scientific Polymer Products); (6) poly(vinylamine) (such as #1562, available from Poly Sciences Inc.); (7) poly(vinyl alcohol) alkoxylated, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly(vinyl alcohol) ethoxylated #6573, available from Poly Sciences Inc.); (8) poly(vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly(vinyl pyrrolidone-diethylaminomethylmethacrylate) #16294 and #16295, available from Poly Sciences Inc.); (9) vinyl alcohol-vinyl acetate copolymer (such as #379, available from Scientific Polymer Products); (10) vinyl alcohol-vinyl butyral copolymer (such as #381, available from Scientific Polymer Products); (c) formaldehyde resins, such as (1) melamine-formaldehyde resin (such as BC 309, available from British Industrial Plastics Limited); (2) urea-formaldehyde resin (such as BC777, available from British Industrial Plastics Limited); and (3) alkylated urea-formaldehyde resins, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated urea-formaldehyde resins, available from American Cyanamid Company as Beetle 65); (d) ionic polymers, such as (1) poly(2-acrylamide-2-methyl propane sulfonic acid) (such as #175 available from Scientific Polymer Products); (2) poly (N,N-dimethyl-3,5-dimethylene piperidinium chloride) (such as #401, available from Scientific Polymer Products); and (3) poly(methylene-guanidine) hydrochloride (such as #654, available from Scientific Polymer Products); (e) latex polymers, such as (1) cationic, anionic, and nonionic styrene-butadiene latexes (such as that available from Gen Corporation Polymer Products, such as RES 4040 and RES 4100, available from Unocal Chemicals, and such as DL 6672A, DL6638A, and DL6663A, available from Dow Chemical Company); (2) ethylene-vinylacetate latex (such as Airflex 400, available from Air Products and Chemicals Inc.); and (3) vinyl acetate-acrylic copolymer latexes (such as synthemul 97-726, available from Reichhold Chemical Inc., Resyn 25-1110 and Resyn 25-1140, available from National Starch Company, and RES 3103 available from Unocal Chemicals); (f) maleic anhydride and maleic acid containing polymers, such as (1) styrene-maleic anhydride copolymers (such as that available as Scripset from Monsanto, and the SMA series available from Arco); (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173, available from Scientific Polymer Products); (3) alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308, available from Poly Sciences Inc., also available as EMA from Monsanto Chemical Company); (4) butadiene-maleic acid copolymers (such as #07787, available from Poly Sciences Inc.); (5) vinylalkylether-maleic acid copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer, available from GAF Corporation as Gantrez S-95); and (6) alkyl vinyl ether-maleic acid esters, wherein alkyl has at least one carbon atom and wherein the number of carbon atoms is such that the material is water soluble, preferably from 1 to about 20 carbon atoms, more preferably from 1 to about 10 carbon atoms, such as methylene, ethylene, propylene, butylene, and the like (such as methyl vinyl ether-maleic acid ester #773, available from Scientific Polymer Products); (g) acrylamide containing polymers, such as (1) poly(acrylamide) (such as #02806, available from Poly Sciences Inc.); (2) acrylamide-acrylic acid copolymers (such as #04652, #02220, and #18545, available from Poly Sciences Inc.); and (3) poly(N,N-dimethyl acrylamide) (such as #004590, available from Poly Sciences Inc.); and (h) poly(alkylene imine) containing polymers, wherein alkylene has two (ethylene), three (propylene), or four (butylene) carbon atoms, such as (1) poly(ethylene imine) (such as #135, available from Scientific Polymer Products); (2) poly(ethylene imine) epichlorohydrin (such as #634, available from Scientific Polymer Products); and (3) alkoxylated poly(ethylene imine), wherein alkyl has one (methoxylated), two (ethoxylated), three (propoxylated), or four (butoxylated) carbon atoms (such as ethoxylated poly (ethylene imine #636, available from Scientific Polymer Products); and the like, as well as blends or mixtures of any of the above, with starches and latexes being particularly preferred because of their availability and applicability to paper. Any mixtures of the above ingredients in any relative amounts can be employed.

The first ink receiving layer coating composition capable of receiving images from a xerographic copier is present on the front side of the substrate of the coated printable laminateable labels of the present invention in any effective thickness. Typically, the total thickness of this coating layer is from about 0.1 to about 25 microns and preferably from about 0.5 to about 5 microns, although the thickness can be outside of these ranges. In the first coating composition, the binder, such as binder (a) can be present within the coating in any effective amount. In a total of 100 parts by weight, the binder or mixtures thereof are present in amounts of from about 5 parts by weight to about 50 parts by weight, the ink spreading agent such as a poly(alkylene oxide), homologs and copolymers thereof are present in the first layer coating composition in amounts of from about 60 parts by weight to about 1 part by weight, the antistatic agents or mixtures thereof for xerographic labels are present in the first coating composition, in amounts of from about 15 parts by weight to about 2 parts by weight, the lightfastness inducing compounds or mixtures thereof are present in the first coating composition, in amounts of from about 15 parts by weight to about 1 part by weight, the fillers of the first layer coating composition are present in amounts of from about 1 part by weight to about 45 parts by weight, and the biocides of the first layer coating composition are present in amounts of from about 4 parts by weight to about 1 part by weight The aforementioned amounts can be determined, for example, as follows:

Various blends of the binder, the toner spreading agent, antistatic agent when present, lightfastness inducing agent, fillers, and the biocide were prepared in a solvent, such as toluene, and coated on to various base sheets such as paper, TESLIN™ and opaque MYLAR® to yield coated labels with a single layer thereover and thereunder. After drying the base sheets at 100° C., these were tested for coating adhesion to the base sheet, printed with a Xerox Corporation 5760 digital Color Machine to, for example, check print quality and lightfastness. The data was analyzed statistically for optimum range of compositions. A preferred composition range for the first layer coating of the coated label is the binder present in amounts of from about 20 parts by weight to about 50 parts by weight, the toner spreading agent, present in an amount of from about 60 parts by weight to about 4 parts by weight, the antistatic agent, present in an amount of from about 10 parts by weight to about 3 parts by weight, the lightfastness inducing agent or mixtures thereof present in amounts of from about 6 parts by weight to about 2 parts by weight, the fillers, present in amounts of from about 1 part by weight to about 40 parts by weight, and the biocide compounds or mixtures thereof present in amounts of from about 3 parts by weight to about 1 part by weight based on total of 100 parts (20+60+10+6+3+1) to (50+4+3+2+40+1).

The xerographically writeable hydrophobic polymers of the first layer coating composition present on the front side of the substrate include poly(vinyl formal), such as #012, available from Scientific Polymer Products, poly(vinyl butyral), such as #043, #511, #507, available from Scientific Polymer Products, vinyl alcohol-vinyl butyral copolymers such as #381, available from Scientific Polymer Products, vinyl alcohol-vinyl acetate copolymers such as #379, available from Scientific Polymer Products, vinyl chloride-vinyl acetate copolymers such as #063, #068, #070, #422 available from Scientific Polymer Products, vinyl chloride-vinyl acetate-vinyl alcohol terpolymers such as #064, #427, #428 available from Scientific Polymer Products, vinyl chloride-vinylidene chloride copolymers such as #058, available from Scientific Polymer Products, vinylidene chloride-acrylonitrile copolymers such as #395, #396, available from Scientific Polymer Products, cyanoethylated cellulose, such as #091, available from Scientific Polymer Products, cellulose acetate hydrogen phthalate, such as #085, available from Scientific Polymer Products, hydroxypropylmethyl cellulose phthalate, such as HPMCP, available from Shin-Etsu Chemical, hydroxypropyl methyl cellulose succinate, such as HPMCS, available from Shin-Etsu Chemical, cellulose triacetate, such as #031, available from Scientific Polymer Products, cellulose acetate butyrate, such as #077, available from Scientific Polymer Products, cellulose propionate such as #2052, available from Scientific Polymer Products, polystyrene such as #039A, #039D, #845, #756 available from Scientific Polymer Products, poly(4-methylstyrene), such as #315, #593, #839, available from Scientific Polymer Products, poly(α-methylstyrene), such as #2055, available from Scientific Polymer Products, poly (tert-butylstyrene), such as #177, available from Scientific Polymer Products, poly(2-chlorostyrene), such as #777, available from Scientific Polymer Products, poly(3-chlorostyrene), such as #778, available from Scientific Polymer Products, poly(4-chlorostyrene), such as #257, available from Scientific Polymer Products, poly(2-bromostyrene), such as #775, available from Scientific Polymer Products, poly(3-bromostyrene), such as #776, available from Scientific Polymer Products, poly(4-bromostyrene), such as #212, available from Scientific Polymer Products, poly(4-methoxy styrene), such as #314, available from Scientific Polymer Products, poly(2,4,6-tribromostyrene), such as #166, available from Scientific Polymer Products, styrene-butylmethacrylate copolymers, such as #595, available from Scientific Polymer Products, styrene-acrylonitrile copolymers, such as #495, available from Scientific Polymer Products, styrene-allyl alcohol copolymers, such as #393, #394 available from Scientific Polymer Products, poly(2-vinyl pyridine) such as #813, #814 available from Scientific Polymer Products, poly(4-vinyl pyridine) such as #700, #840 available from Scientific Polymer Products, poly(2-vinyl pyridine-co-styrene) such as #319, available from Scientific Polymer Products, poly(4-vinyl pyridine-co-styrene) such as #416, #859 available from Scientific Polymer Products, poly(4-vinyl pyridine-co-butylmethacrylate) such as #312, #667, #858, available from Scientific Polymer Products, poly(vinyl toluene) such as #261, available from Scientific Polymer Products, poly(2-vinyl naphthalene) such as #163, available from Scientific Polymer Products, poly (methylmethacrylate) such as #037A, #037B, #037D, #307, #424, #689, available from Scientific Polymer Products, poly(ethyl methacrylate) such as #113, #308, available from Scientific Polymer Products, poly(isopropyl methacrylate) such as #476, available from Scientific Polymer Products, poly(phenyl methacrylate) such as #227, available from Scientific Polymer Products, poly(phenoxy ethyl methacrylate) such as #893, available from Scientific Polymer Products, poly(2-hydroxypropyl methacrylate) such as #232, available from Scientific Polymer Products, polyamide resin such as #385, #386, #387, #388, #389, #390, available from Scientific Polymer Products, poly(p-phenylene ethersulfone) (such as #392, available from Scientific Polymer Products), polysulfones, such as #046, available from Scientific Polymer Products, aromatic ester carbonate copolymers, such as APE KLI-9306, APE KLI-9310, available from Dow Chemical Company, polycarbonates, such as #035, available from Scientific Polymer Products, α-methylstyrene-dimethylsiloxane block copolymers, such as PS 0965, available from Petrarch Systems, dimethyl siloxane-bisphenol A carbonate block copolymers, such as PSO99, available from Petrarch Systems, and poly(2,6-dimethyl p-phenylene oxide), such as #126, available from Scientific Polymer Products.

Examples of ink spreading agents or components include oxyalkylene-containing polymers such as poly(oxy methylene), such as #009, available from Scientific Polymer Products, poly(oxyethylene) or poly(ethylene oxide), such as POLY OX WSRN-3000, available from Union Carbide Corporation, ethylene oxide/propylene oxide copolymers, such as ethylene oxide/propylene oxide/ethylene oxide triblock copolymer, such as Alkatronic EGE-31-1, available from Alkaril Chemicals, propylene oxide/ethylene oxide/propylene oxide triblock copolymers, such as Alkatronic PGP 3B-1, available from Alkaril Chemicals, tetrafunctional block copolymers derived from the sequential addition of ethylene oxide and propylene oxide to ethylene diamine, the content of ethylene oxide in these block copolymers being from about 5 to about 95 percent by weight, such as Tetronic 50R8, available from BASF Corporation, ethylene oxide/2-hydroxyethyl methacrylate/ethylene oxide and ethylene oxide/hydroxypropyl methacrylate/ethylene oxide triblock copolymers, which can be synthesized via free radical polymerization of hydroxyethyl methacrylate or hydroxypropyl methacrylate with 2-aminoethanethiol using α,α'-azobisisobutyronitrile as initiator and reacting the resulting amino-semitelechelic oligo-hydroxyethyl methacrylate or aminohydroxypropyl methacrylate with an isocyanate-polyethylene oxide complex in chlorobenzene at 0° C., and precipitating the reaction mixture in diethylether, filtering and drying in vacuum, ethylene oxide/4-vinyl pyridine/ethylene oxide triblock copolymers, which can be synthesized via anionic polymerization of 4-vinyl pyridine with sodium naphthalene as initiator at −78° C. and then adding ethylene oxide monomer, the reaction being accomplished in an explosion proof stainless steel reactor, ionene/ethylene oxide/ionene triblock copolymers, which can be synthesized via quaternization reaction of one end of each 3—3 ionene with the halogenated (preferably brominated) poly (oxyethylene) in methanol at about 40° C., ethylene oxide/isoprene/ethylene oxide triblock copolymers, which can be synthesized via anionic polymerization of isoprene with sodium naphthalene in tetrahydrofuran as solvent at −78° C. and then adding monomer ethylene oxide and polymerizing the reaction for three days, after which time the reaction is quenched with methanol, the ethylene oxide content in the aforementioned triblock copolymers being from about 20 to about 70 percent by weight and preferably about 50 percent by weight, and the like, epichlorohydrin-ethyleneoxide copolymer such as #155 available from Scientific Polymer Products, and mixtures thereof. The preferred oxyalkylene containing polymers are poly(ethylene oxide), poly (propylene oxide), and ethylene oxide/propylene oxide block copolymers primarily because of their availability and lower cost.

Further, the ink/toner receiving layers of the labels of the present invention contains a lightfastness inducing component including UV absorbing compounds including, glycerol ρ-amino benzoate, available as Escalol 106 from Van Dyk Corporation; resorcinol mono benzoate, available as RBM from Eastman Chemicals; octyl dimethyl amino benzoate, available as Escalol 507 from Van Dyk Corporation; hexadecyl 3,5-di-tert-butyl-4-hydroxy-benzoate, available as Cyasorb UV-2908, #41,320-8 from Aldrich Chemical Company; octyl salicylate, available as Escalol 106 from Van Dyk Corporation; octyl methoxy cinnamate, available as Parasol MCX, from Givaudan Corporation; 4-allyloxy-2-hydroxybenzophenone, available as Uvinul 600 #41,583-9 from Aldrich Chemical Company; 2-hydroxy-4-methoxy benzophenone, available as Anti UVA from Acto Corporation; 2,2'-dihydroxy-4,4'-dimethoxy benzophenone, available as Uvinul D 49 #D11,100-7 from Aldrich Chemical Company; 2-hydroxy-4-(octyloxy)benzophenone, available as Cyasorb UV-531, #41,315-1 from Aldrich Chemical Company; 2-hydroxy-4-dodecyloxy benzophenone, available as DOBP, from Eastman Chemicals; 2-(2'-hydroxy-5'-methylphenyl)benzotriazole, available as Tinuvin 900 from Ciba Geigy Corporation; 2-[2'-hydroxy-3,5-di-(1,1-dimethyl benzyl)phenyl]-2H-benzotriazole, available as Topanex 100BT from ICI America Corporation; bis[2-hydroxy-5-tert-octyl-3-(benzotriazol-2-yl) phenyl methane, available as Mixxim BB/100 from Fairmount Corporation; 2-(3',5'-di-tert-butyl-2'-hydroxyphenyl)-5-chlorobenzotriazole, available as Tinuvin 327, from Ciba Geigy Corporation; 2-(4-benzoyl-3-hydroxyphenoxy) ethylacrylate (Cyasorb UV-416, #41,321-6, available from Aldrich Chemical Company); poly[2-(4-benzoyl-3-hydroxyphenoxy)ethylacrylate] (Cyasorb UV-2126, #41, 323-2, available from Aldrich Chemical Company), N-(ρ-ethoxycarbonyl phenyl)-N'-ethyl-N'-phenyl formadine, available as Givesorb UV-2 from Givaudan Corporation; 1,1-(1,2-ethane-diyl) bis(3,3,5,5-tetramethyl piperazinone), available as Good-rite UV 3034 from Goodrich Chemicals; tris(3,5-di-tert-butyl-4-hydroxybenzyl)isocyanurate, available as Good-rite UV 3114 from Goodrich Chemicals; nickel bis(o-ethyl(3,5-di-tert-butyl-4-hydroxybenzyl) phosphonate, available as Irgastab 2002 from Ciba Geigy Corporation; [2,2,6,6-tetramethyl-4-piperidinyl)-1,2,3,4-butane tetracarboxylate, available as Mixxim HALS 57 from Fairmount Corporation; [2,2,6,6-tetramethyl-4-piperidinyl/β,β,β',β'-tetramethyl-3,9-(2,4,8,10-tetraoxospiro (5,5) undecane)diethyl]-1,2,3,4-butane tetracarboxylate, available as Mixxim HALS 68 from Fairmount Corporation; [1,2,2,6,6-pentamethyl-4-piperidinyl/β,β,β',β'-tetramethyl-3,9-(2,4,8,10-tetraoxospiro (5,5) undecane)diethyl]-1,2,3,4-butane tetracarboxylate, available as Mixxim HALS 63 from Fairmount Corporation; 2-dodecyl-N-(2,2,6,6-tetramethyl-4-piperidinyl) succinimide, available as Cyasorb UV-3581, #41,317-8, from Aldrich Chemical Company); 2-dodecyl-N-(1,2,2,6,6-pentamethyl-4-piperidinyl) succinimide, available as Cyasorb UV-3604, #41,318-6, from Aldrich Chemical Company; N-(1-acetyl-2,2,6,6-tetramethyl-4-piperidinyl)-2-dodecyl succinimide, available as Cyasorb UV-3668, #41,319-4, from Aldrich Chemical Company; tetra sodium N-(1,2-dicarboxyethyl)-N-octadecyl sulfosuccinamate, available as Aerosol 22N from American Cyanamid Corporation; nickel dibutyldithiocarbamate, available as UV-Chek AM-105 from Ferro Corporation; poly(4-hydroxy-2,2,6,6-tetramethyl-1-piperidine ethanol/dimethyl succinic acid), available as Tinuvin 622LD from Ciba-Geigy Corporation; poly(3,5-di-tert-butyl-4-hydroxy hydrocinnamic acid ester/1,3,5-tris(2-hydroxyethyl)-5-triazine-2,4,6(1H,3H,5H)-trione, available as Good-rite 3125 from Goodrich Chemicals; poly[N,N-bis(2,2,6,6-tetramethyl-4-piperidinyl)-1,6-hexanediamine-co-2,4-dichloro-6-morpholino-1,3,5-triazine), available as Cyasorb UV-3346, #41,324-0, from Aldrich Chemical Company; 1-[N-[poly(3-allyloxy-2-hydroxypropyl)-2-aminoethyl]-2-imidazolidinone, #41,026-8, available from Aldrich Chemical Company; or poly(2-ethyl-2-oxazoline) #37,284-6, #37, 285-4, #37,397-4, available from Aldrich Chemical Company.

The lightfastness component usually includes a UV absorber component, an antioxidant and a antiozoant, and wherein the antioxidant may also function as an antiozoant, and wherein each of the aforementioned components are present in various effective amounts, such as for example about 1 to about 3 weight percent, or parts. Examples of the lightfastness inducing antioxidant compounds such as didodecyl 3,3'-thiodipropionate, available as Cyanox, LTDP, #D12,840-6, from Aldrich Chemical Company; ditridecyl 3,3'-thiodipropionate, available as Cyanox 711, #41,311-9, from Aldrich Chemical Company; ditetradecyl 3,3'-thiodipropionate, available as Cyanox, MTDP, #41,312-7, from Aldrich Chemical Company; dicetyl 3,3'-thiodipropionate, available as Evanstab 16 from Evans Chemetics Corporation; dioctadecyl 3,3'-thiodipropionate, available as Cyanox, STDP, #41,310-0, from Aldrich Chemical Company; triethyleneglycol bis[3-(3'-tert-butyl-4'-hydroxy-5'-methylphenyl) propionate], available as Irganox 245 from Ciba-Geigy Corporation; octadecyl 3-(3,5-di-tert-butyl-4-hydroxyphenyl)propionate, available as Ultranox 276 from General Electric Company; 1,6-hexamethylene bis(3,5-di-tert-butyl-4-hydroxy hydrocinnamate), available as Irganox 259 from Ciba-Geigy Corporation; tetrakis[methylene(3,5-di-tert-butyl-4-hydroxy hydrocinnamate), available as Irganox 1010 from Ciba-Geigy Corporation; thiodiethylenebis(3,5-di-tert-butyl-4-hydroxy) hydrocinnamate, available as Irganox 1035 from Ciba-Geigy Corporation; octadecyl 3,5-di-tert-butyl-4-hydroxy hydrocinnamate, available as Irganox 1076 from Ciba-Geigy Corporation; N,N'-hexamethylenebis(3,5-di-tert-butyl-4-hydroxy hydrocinnamide), available as Irganox 1098 from Ciba-Geigy Corporation; 2,2-bis[4-(2-(3,5-di-tert-butyl-4-hydroxyhydrocinnamoyloxy))ethoxy phenyl] propoane, available as Topanol 205, from ICI America Corporation; N-stearoyl-ρ-aminophenol, available as Sucnox-18 from Hexcel Corporation; 2,6-di-tert-butyl-4-methyl phenol, available as Ultranox 226 from General Electric Company; 2,6-di-tert-butyl-ρ-cresol, available as Vulkanox KB from Mobay Chemicals; 2,6-di-tert-butyl-α-dimethylamino-ρ-cresol, available as Ethanox 703 from Ethyl Corporation; 2,2'-isobutylidene-bis(4,6-dimethyl phenol), available as Vulkanox NKF from Mobay Chemicals; 2,2'-methylenebis(6-tert-butyl-4-methylphenol), available as Cyanox 2246, #41,315-5, from Aldrich Chemical Company; 2,2'-methylene bis(6-tert-butyl-4-ethylphenol), available as Cyanox 425, #41,314-3, from Aldrich Chemical Company; tris(4-tert-butyl-3-hydroxy-2,6-dimethylbenzyl) isocyanurate, available as Cyanox 1790, #41,322-4, LTDP, #D12,840-6, from Aldrich Chemical Company; 1,3,5-trimethyl-2,4,6-tris(3,5-di-tert-butyl-4-hydroxybenzyl) benzene, available as Ethanox 300, #41,328-3, from Aldrich Chemical Company; triphenyl phosphite, available as Lankromark LE65 from Harcros Corporation; tris (nonyl phenyl) phosphite, available as Lankromark LE109 from Harcros Corporation; tris(2,4-di-tert-butylphenyl)phosphite, available as Wytox 240 from Olin Corporation; 2,2'-ethylidene bis(4,6-di-tert-butylphenyl) fluorophosphonite, available as Ethanox 398 from Ethyl Corporation; octylated diphenylamine, available as Anchor ODPA from Anchor Corporation; N,N'-β,β'-naphthalene-ρ-phenylenediamine, available as Anchor DNPD from Anchor Corporation; 4,4'-methylene-bis(dibutyldithio carbamate), available as Vanlube 7723 from Vanderbilt Corporation; antimony dialkyldithio carbamate, available as Vanlube 73 from Vanderbilt Corporation; antimony dialkylphosphorodithioate, available as Vanlube 622 from Vanderbilt Corporation; molybdenum oxysulfide dithio carbamate, available as Vanlube 622 from Vanderbilt Corporation; 2,2,4-trimethyl-1,2-hydroquinoline, available as Vulkanox HS from Mobay Corporation; and mixtures thereof.

Examples of lightfastness inducing antiozonants include N-isopropyl-N'-phenyl-phenylene diamine, available as Santoflex IP from Monsanto Chemicals; N-(1,3-dimethylbutyl)-N'-phenyl-phenylene diamine, available as Santoflex 13 from Monsanto Chemicals; N,N'-di(2-octyl)-ρ-phenylene diamine, available as Antozite-1 from Vanderbilt Corporation; N,N'-bis(1,4-dimethyl pentyl)-ρ-phenylene diamine, available as Santoflex 77 from Monsanto Chemicals; 2,4,6-tris-(N-1,4-dimethyl pentyl-ρ-phenylene diamino)-1,3,5-triazine, available as Durazone 37 from Uniroyal Corporation; 6-ethoxy-1,2-dihydro-2,2,4-trimethyl quinoline, available as Santoflex AW from Monsanto Chemicals; bis(1,2,3,6-tetrahydrobenzaldehyde) pentaerythritol acetal, available as Vulkazon AFS/LG from Mobay Corporation; paraffin wax, available as Petrolite C-700, Petrolite C-1035, from Petrolite Corporation; and mixtures thereof.

Examples of biocides include (A) nonionic biocides, such as (1) 2-hydroxypropylmethane thiosulfonate (Busan 1005, available from Buckman Laboratories Inc.); (2) 2-(thio cyanomethyl thio) benzothiazole (Busan 30WB, 72WB, available from Buckman Laboratories Inc.); (3) methylene bis(thiocyanate) (Metasol T-10, available from Calgon Corporation; AMA-110, available from Vinings Chemical Company; Vichem MBT, available from Vineland Chemical Company; Aldrich 10, 509-0); (4) 2-bromo-4'-hydroxyacetophenone (Busan 90, available from Buckman Laboratories); (5) 1,2-dibromo-2,4-dicyano-butane (Metasol CB-210, CB-235, available from Calgon Corporation); (6) 2,2-dibromo-3-nitropropionamide (Metasol RB-20, available from Calgon Corporation; Amerstat 300, available from Drew Industrial Div.); (7) N-α-(1-nitroethyl benzylethylene diamine) (Metasol J-26, available from Calgon Corporation); (8) dichlorophene (G-4, available from Givaudan Corporation); (9) 3,5-dimethyl tetrahydro-2H-1, 3,5-thiadiazine-2-thione (SLIME-TROL RX-28, available from Betz Paper Chem Inc.; Metasol D3T-A, available from Calgon Corporation; SLIME ARREST, available from Western Chemical Company); (10) a nonionic blend of a sulfone, such as bis(trichloromethyl) sulfone and methylene bisthiocyanate (available as SLIME-TROL RX-38A from Betz Paper Chem Inc.); (11) a nonionic blend of methylene bisthiocyanate and bromonitrostyrene (available as SLIME-TROL RX-41 from Betz Paper Chem Inc.); (12) a nonionic blend of 2-(thiocyanomethylthio) benzothiazole (53.2 percent by weight) and 2-hydroxypropyl methanethiosulfonate (46.8 percent by weight) (available as BUSAN 25 from Buckman Laboratories Inc.); (13) a nonionic blend of methylene bis (thiocyanate) 50 percent by weight and 2-(thiocyanomethylthio) benzothiazole 50 percent by weight (available as BUSAN 1009, 1009WB from Buckman Laboratories Inc.); (14) a nonionic blend of 2-bromo4'-hydroxyacetophenone (70 percent by weight) and 2-(thiocyanomethylthio) benzothiazole (30 percent by weight) (BUSAN 93, available from Buckman Laboratories Inc.); (15) a nonionic blend of 5-chloro-2-methyl-4-isothiazoline-3-one (75 percent by weight) and 2-methyl-4-isothiazolin-3-one (25 percent by weight) (available as AMERSTAT 250 from Drew Industrial Division; NALCON 7647, from NALCO Chemical Company; Kathon LY, from Rohm and Haas Company); and the like, as well as mixtures thereof; (B) anionic biocides, such as (1) anionic potassium N-hydroxymethyl-N-methyl-dithiocarbamate (available as BUSAN 40 from Buckman Larboratories Inc.); (2) an anionic blend of N-hydroxymethyl-N-methyl dithiocarbamate (80 percent by weight) and sodium 2-mercapto benzothiazole (20 percent by weight) (available as BUSAN 52 from Buckman Laboratories Inc.); (3) an anionic blend of sodium dimethyl dithiocarbamate, 50 percent by weight, and (disodium ethylenebis-dithiocarbamate), 50 percent by weight, (available as METASOL 300 from Calgon Corporation; AMERSTAT 272 available from Drew Industrial Division; SLIME CONTROL F from Western Chemical Company); (4) an anionic blend of N-methyldithiocarbamate, 60 percent by weight, and disodium cyanodithioimidocarbonate, 40 percent by weight, (available as BUSAN 881 from Buckman Laboratories Inc.); (5) an anionic blend of methylene bis-thiocyanate (33 percent by weight), sodium dimethyl-dithiocarbamate (33 percent by weight), and sodium ethylene bisdithiocarbamate (33 percent by weight) (available as AMERSTAT 282 from Drew Industrial Division; AMA-131 from Vinings Chemical Company); (6) sodium dichlorophene (G-4-40, available from Givaudan Corporation); and the like, as well as mixtures thereof; (C) cationic biocides, such as (1) cationic poly(oxyethylene (dimethylamino)-ethylene (dimethylamino) ethylene dichloride) (Busan 77, available from Buckman Laboratories Inc.); (2) a cationic blend of methylene bisthiocyanate and dodecyl guanidine hydrochloride (available as SLIME TROL RX-31, RX-32, RX-32P, RX-33, from Betz Paper Chem Inc.); (3) a cationic blend of a sulfone, such as bis(trichloromethyl) sulfone and a quaternary ammonium chloride (available as SLIME TROL RX-36 DPB-865 from Betz Paper Chem. Inc.); (4) a cationic blend of methylene bis thiocyanate and chlorinated phenols (available as SLIME-TROL RX-40 from Betz Paper Chem Inc.); and the like, and well as mixtures thereof. The biocide can be present in any effective amount; typically, the biocide is present in an amount of from about 0.1 to about 3 percent by weight of the coating, although the amount can be outside this range.

Monoester sulfosuccinates, diester sulfosuccinates and sulfosuccinamates are examples of anionic antistatic components which have been found suitable as an optional component for use in the first ink receiving coating. Suitable cationic antistatic components comprise diamino alkanes, quaternary salts, quaternary acrylic copolymer latexes, ammonium quaternary salts as disclosed in U.S. Pat. No. 5,320,902; phosphonium quaternary salts as disclosed in U.S. Pat. No. 5,760,809, and sulfonium, thiazolium and benzothiazolium quaternary salts as disclosed in U.S. Pat. No. 5,314,747, the disclosures of which are each totally incorporated herein by reference.

In addition, the invention first ink jet receptive layer coating can contain cationic dye mordants in effective amounts, such as in amounts of from about 3 to about 30 percent by weight of the coating composition when used for ink jet printing and from about 3 to about 10 percent when used for xerographic applications. Examples of cationic dye mordants include quaternary salts, such as Cordex AT-172 and other materials available from Finetex Corporation, quaternary acrylic copolymer latexes; also suitable are monoammonium compounds as disclosed in, for example, U.S. Pat. No. 5,320,902, the disclosure of which is totally incorporated herein by reference, formaldehyde-free Gardol DR/NF™, available from Apollo Chemical Corporation, polyquaternary amine Perchem 553™, available from Chem Link Industrial, polyquaternary amine, Poly Plus 1290™, available from Betz Paper Chem Inc.; Armosoft 420-90™, available from Akzo Chemie Chemicals, Mirapol A-15 and Mirapol WT, available from Miranol, Incorporated, Dayton, N.J., prepared as disclosed in U.S. Pat. No. 4,157,388, the disclosure of which is totally incorporated herein by reference, Mirapol AZ-1, available from Miranol, Incorporated, prepared as disclosed in U.S. Pat. No. 4,719,282, the disclosure of which is totally incorporated herein by reference, Mirapol AD-1, available from Miranol, Incorporated, prepared as disclosed in U.S. Pat. No. 4,157,388, Mirapol 9, Mirapol 95, and Mirapol 175, available from Miranol, Incorporated, Dayton, N.J., prepared as disclosed in U.S. Pat. No. 4,719,282, and the like, and mixtures thereof. Also suitable are phosphonium compounds, such as, for example, those disclosed in U.S. Pat. No. 5,760,809, the disclosure of which is totally incorporated herein by reference.

Examples of filler components include hollow microspheres including Eccospheres MC-37 (sodium borosilicate glass), Eccospheres FTD 202 (high silica glass, 95 percent of $S10_2$), and Eccospheres SI (high silica glass, 98 percent of $S10_2$), all available from Emerson and Cuming Inc.; Fillite 200/7 (alumino-silicate ceramic, available from Fillite U.S.A.); Q-Cel 300 (sodium borosilicate, available from Philadelphia Quartz); B23/500 (soda lime glass, available from 3M Company); Ucar BJ0-0930 (phenolic polymers, available from Union Carbide); Miralite 177 (vinylidene chloride-acrylonitrile, available from Pierce & Stevens Chemical Corporation); and the like. Examples of solid microspheres include Spheriglass E250P2 and 10002A (soda-lime glass A-glass, E-glass), available from Potters Industries; Micro-P (soda-lime glass), available from D.J. Enterprises; ceramic microspheres (available from Fillite U.S.A. and Zeelan Industries); glass beads 3 to 10 microns (#07666, available from Polymer Sciences Inc.); solid plastic microspheres, available from Rohm & Haas, Dow Chemicals, Diamond Shamrock, and E. I. DuPont de Nemours & Company; hollow composite microspheres of polyvinylidene chloride/acrylonitrile copolymer shell, 15 percent by weight, and calcium carbonate, 85 percent by weight, available as Dualite M 6001 AE, and Dualite M 6017 AE, from Pierce & Stevens Corporation; and the like. Mixtures of two or more types of microspheres can also be employed. Further information regarding microspheres is disclosed in, for example, *Encyclopedia of Polymer Science and Engineering,* vol. 9, page 788 et seq., John Wiley and Sons (New York 1987), the disclosure of which is totally incorporated herein by reference. Also, as fillers there can be selected stearate coated calcium carbonate, available as Camet-CAL, Camet-CAL ST from Genstar Stone Products Company; sodium metasilicate anhydrous, available as Drymet 59 from Crossfield Chemicals, Incorporated, sodium metasilicate pentahydrate Crystamet 1020, Crystamet 2040, Crystamet 3080 from Crossfield Chemicals, Incorporated; organophilic montmorillonitrile clay, available as Bentone 38CG, and magnesium aluminum silicate chemically modified, available as Bentone 38EV from Rheox Incorporated; magnesium carbonate, available as Elastocarb Tech Light, Elastocarb Tech Heavy, Elastocarb UF from Morton International; magnesium oxide, available as Elastomag 100, Elastomag 100 R, Elastomag 170, Elastomag 170 micropellet; zirconium oxide (SF-EXTRA, available from Z-Tech Corporation), colloidal silicas, such as Syloid 74, available from Grace Company (preferably present, in one embodiment, in an amount of from about 10 to about 70 percent by weight percent), amorphous silica, available as Flow-Gard CC 120, Flow-Gard CC 140, Flow-Gard CC 160 from PPG Industries, titanium dioxide (available as Rutile or Anatase from NL Chem Canada, Inc.), hydrated alumina (Hydrad TMC-HBF, Hydrad TM-HBC, available from J. M. Huber Corporation), barium sulfate (K.C. Blanc Fix HD80, available from Kali Chemie Corporation), calcium carbonate (Microwhite Sylacauga Calcium Products), high brightness clays (such as Engelhard Paper Clays), calcium silicate (available from J. M. Huber Corporation), cellulosic materials insoluble in water or any organic solvents (such as those available from Scientific Polymer Products), blends of calcium fluoride and silica, such as Opalex-C, available from Kemira O.Y, zinc oxide, such as Zoco Fax 183, available from Zo Chem, blends of zinc sulfide with barium sulfate, such as Lithopane, available from Schteben Company, barium titanate, #20,810-8 available from Aldrich Chemicals, antimony oxide #23,089-8 available from Aldrich Chemicals, and the like, and mixtures thereof; brightener fluorescent pigments of Coumarin derivatives, such as Formula #633, available from Polymer Research Corporation of America; or fluorescent fillers of oxazole derivatives, such as Formula #733, available from Polymer Research Corporation of America.

The second heat layer coating composition in contact with the backside of the substrate, thus the substrate is situated between the first coating and the second coating, is present on the substrate of the printable laminateable tapes of the present invention in any effective thickness. Typically, the total thickness of the second coating layer is from about 0.1 to about 25 microns and preferably from about 0.5 to 10 microns, although the thickness can be outside of these ranges. In the second layer polymer composition in contact with the backside of the substrate, the binder can be present within the coating in any effective amount; typically, the binder or mixture thereof is present in amounts of from about 1 percent by weight to about 100 percent by weight and when an optional plasticizer, such as a polyoxyalkylene component or mixture thereof, is included it is present in amounts of from about 90 percent by weight to about 10 percent by weight, and the binder is present in the resulting mixture in an amount of from about 10 to about 90 weight percent, or parts.

The second heat layer polymers in contact with the backside of the substrate include water dispersible polymers, such as (A) latex polymers (polymers capable of forming a latex refers to a polymer that forms in water or in an organic solvent a stable colloidal system in which the disperse phase is polymeric); examples of suitable latex-forming polymers include rubber latex, such as Neoprene, available from Serva Biochemicals, acrylic emulsion latex, such as Rhoplex B-15J, Rhoplex P-376 from Rohm and Haas Company Synthetic Rubber Latex 68-302 from Reichhold Chemicals Inc., as well as mixtures thereof; (B) water soluble polymers, such as formaldehyde resins, such as melamine-formaldehyde resin (such as BC 309, available from British Industrial Plastics Limited), urea-formaldehyde resin (such as BC777, available from British Industrial Plastics Limited), and alkylated urea-formaldehyde resins, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated urea-formaldehyde resins, available from American Cyanamid Company as Beetle 65); maleic anhydride and maleic acid containing polymers, such as vinyl alkyl ether-maleic anhydride copolymers, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173, available from Scientific Polymer Products), alkylene-maleic anhydride copolymers, wherein alkylene has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308, available from Poly Sciences Inc., also available as EMA from Monsanto Chemical Company), butadiene-maleic acid copolymers (such as #07787, available from Poly Sciences Inc.), octadecene-1-maleic anhydride copolymer, such as #573 available from Scientific Polymer Products, vinylalkylether homopolymer, such as polyvinylmethylether #025 available from Scientific Polymer Products, and vinylalkylether-maleic acid copolymers, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer, available from GAF Corporation as Gantrez S-95), and alkyl vinyl ether-maleic acid esters, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like (such as methyl vinyl ether-maleic acid ester #773, available from Scientific Polymer Products); (C) solvent soluble polymers, such as poly (hydroxyalkylacrylates), wherein alkyl is methyl, ethyl, or propyl, including poly(2-hydroxyethyl acrylate), such as #850, available from Scientific Polymer Products, and poly (hydroxypropyl acrylate), such as #851, available from Scientific Polymer Products, poly(ethyl acrylate), such as #231, available from Scientific Polymer Products, poly(n-propyl acrylate), such as #877, available from Scientific Polymer Products, poly(isopropyl acrylate), such as #475, available from Scientific Polymer Products, poly(n-butyl acrylate), such as #234, available from Scientific Polymer Products, poly(tert-butyl acrylate), such as #223, available from Scientific Polymer Products, poly(2-methoxy ethyl acrylate), such as #891, available from Scientific Polymer Products, poly(benzyl acrylate), such as #883, available from Scientific Polymer Products, poly(n-hexyl acrylate), such as #640, available from Scientific Polymer Products, poly(2-ethylhexyl acrylate), such as #249, available from Scientific Polymer Products, poly(octyl acrylate), such as #298, available from Scientific Polymer Products, poly (isooctyl acrylate), such as #881, available from Scientific Polymer Products, poly(decyl acrylate), such as #216, available from Scientific Polymer Products, poly(isodecyl acrylate), such as #875, available from Scientific Polymer Products, poly(lauryl acrylate), such as #252, available from Scientific Polymer Products, poly(cyclohexyl acrylate), such as #690, available from Scientific Polymer Products, poly (octadecyl acrylate), such as #298, available from Scientific Polymer Products; poly(n-hexyl methacrylate), such as #217, available from Scientific Polymer Products, poly(2-ethylhexyl methacrylate), such as #229, available from Scientific Polymer Products, poly(n-decyl methacrylate), such as #884, available from Scientific Polymer Products, poly(isodecyl methacrylate), such as #220, available from Scientific Polymer Products, poly(lauryl methacrylate), such as #168, available from Scientific Polymer Products, poly (octadecyl methacrylate), such as #167, available from Scientific Polymer Products; polyalkylenes and their copolymers wherein alkyl has from 2 to about 6 carbon atoms, including ethyl, propyl, butyl, including polyethylene, such as #041, #042, #535, #536, #558, #560, available from Scientific Polymer Products, polypropylene, such as #130, #780, #781, #782, 783, available from Scientific Polymer Products, poly(1-butene), such as #128, #337, #338, available from Scientific Polymer Products, poly(isobutylene), such as #040A, #040B, #040E, #668, #681, #683, #684, available from Scientific Polymer Products, ethylene-propylene copolymer, such as #454, #455, available from Scientific Polymer Products, ethylene-ethylacrylate copolymer such as #358, available from Scientific Polymer Products, isobutylene-co-isoprene copolymer, such as #874, available from Scientific Polymer Products, ethylene-propylene-diene terpolymer, such as #350, #360, #448, #449, available from Scientific Polymer Products; polydienes including polyisoprene, such as #036, #073, available from Scientific Polymer Products, polychloroprene, such as #196, #502, #503, #504, available from Scientific Polymer Products, polybutadiene, such as #206, #552, #894, available from Scientific Polymer Products, polybutadiene phenyl terminated, such as #432, #433, #434, #435, #436, #437, #438, #443, available from Scientific Polymer Products, polybutadiene dicarboxy terminated, such as #294, #524, #525, #526, available from Scientific Polymer Products; vinylalkylether polymers including polyvinylmethylether such as #450, available from Scientific Polymer Products, polyvinylisobutylether, such as #425, available from Scientific Polymer Products; and mixtures thereof.

The peelable release paper covering the adhesive side of the label comprises a release polymer composition present on the substrate of the release paper, preferably known calendered papers, of the present invention in any effective thickness. Typically, the total thickness of the release layer is from about 0.1 to about 25 microns and preferably from about 0.5 to 10 microns, although the thickness can be outside of these ranges.

The peelable release paper covering the adhesive side of the label is comprised of a substrate base, such as low (typically less than 100 mil/minute) porosity paper, preferably known calendered papers, coated with a release composition including polyurethane emulsion, available as grapHsize from Akzo Chemicals Company; polyethylene wax emulsion, available as Dymsol MS-40 from Henkel Corporation, available as Polywax E-2020 from Petrolite Corporation; fluoropolymer dispersions in water, available as Zepel B, Zepel DR from E. I. DuPont de Nemours; fluoropolymer/organic binder dispersion, available as Aerosol CT-88 available from Chem-Trend Incorporated; fluorinated hydrocarbon finish, available as Aquasan 542 from Laurel Products Corporation; fatty acid Chrome Complex, available as Cerol A, from Sandoz Chemical Corporation; Chrome Complex solution in isopropanol, available as Quilon C, Quilon H, Quilon L, Quilon M, Quilon S, from E. I. DuPont; paraffin wax emulsions, available as Paracol from Hercules Incorporated; aliphatic hydrocarbon resin emulsion, available as Picconol A100, Picconol A102, pale rosin aqueous dispersions, available as Dresinol 40, Dresinol 42 from Hercules Incorporated; terpene hydrocarbon resin emulsions, available as Picconol A200, Picconol A201 from Hercules Incorporated; microcrystalline wax finely dispersed in C17 fatty acid, available as Forbest MW 23 from Lucas & Meyer GmbH Company; lanolin alcohol W/O (water/oil) emulsion wax, available as Ceralon from Amerchol Corporation; poly(dimethyl siloxane)-b-poly (propylene oxide)-b-poly(ethylene oxide) copolymers (Alkasil NEP 73-70, Alkaril Chemicals); silicone waxes F221, F222, F251, F755, F789, soluble in isopropanol, available from Wacker Silicones Corporation; aluminum salt wax emulsion, available as Hy-Pel GP-4 from GAF Corporation; metallized wax emulsion, available as Repel-O-Tex D and Repel-O-Tex D-5 from Lyndal Chemical Company; heat stable sodium stearate, aluminum distearate, modified aluminum stearate, all being available from Witco Corporation; magnesium stearate, available as Petrac MG-20, MG-20 NF, and zinc stearate available as Petrac Zn-41, Petrac Zn-42, from Synthetic Products Company; calcium stearate, available as Norfox CS from Norman Fox and Company; stearyl methicone, Abilwax 9809, cetyl dimethicone, Abilwax 9801, stearyl dimethicone, Abilwax 9800, stearoxy dimethicone, Abilwax 2434, behenoxy dimethicone, Abilwax 2440; all being available from TH. Goldschmidt AG., Germany; behenamide, available as Kenamide B, erucamide, available as Kenamide E, stearyl erucamide, available as Kenamide E-180, erucyl erucamide, available as Kenamide E-221, oleamide, available as Kenamide O, oleyl palmitamide, available as Kenamide P-181, stearamide, available as Kenamide S, stearyl stearamide, available as Kenamide S-180, erucyl stearamide, available as Kenamide S-221, ethylene dioleamide, available as Kenamide W-20, ethylene distearamide, available as Kenamide W-40, Kenamide W-40/300; all being available from Witco/Humko Chemical Division; nonyl phenol ethoxylate phosphate ester, available as Emphos CS-141 from Witco Corporation; sodium cumene sulfonate, available as Eltesol SCS, ammonium xylene sulfonate, available as Eltesol AX-40, sodium xylene sulfonate, available as Eltesol SX-30, potassium xylene sulfonate, available as Eltesol PX-40, magnesium xylene sulfonate, available as Eltesol MGX, sodium toluene sulfonate, available as Eltesol ST-90, potassium toluene sulfonate, available as Eltesol PT-45; all being available from Albright & Wilson Company; cocoamphodiacetate, available as Monateric CDX-38, lauroamphodiacetate, Monateric available as 985-A, capryloamphopropionate, available as Monateric Cy Na-50 percent, tallamphopropionate available as Monateric TA-35, isostearoamphopropinate, available as Monateric ISA-35 percent, cocoamphodipropionate, available as Monateric CAM-40, Monateric CEM-38 percent, caprylic/capric monocarboxylic propionate imidazoline derivative, available as Monateric 810A-50, caprylic dicarboxylic propionate, imidazoline derivative, available as Monateric CyA-50 from Mona Industries Incorporated; and mixtures thereof.

The coating compositions of the present invention can be applied to the substrate by any suitable technique. For example, the layer coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. The die can have one or more slots if multilayers are to be applied simultaneously. In the multilayer slot coating, the coating solutions form a liquid stack in the gap where the liquids come in the contact with the moving web to form a coating. The stability of the interface between the two layers depends on wet thickness, density and viscosity ratios of both layers which need to be kept as close to one as possible. Once the desired amount of coating has been applied to the web, the coating is dried, typically at from about 25° C. to about 100° C. in an air dryer.

The Hercules size values recited herein were measured on the Hercules sizing tester (available from Hercules Incorporated) as described in TAPPI STANDARD T-530 pm-83, issued by the Technical Association of the Pulp and Paper Industry. This method is closely related to the widely used ink flotation test. The TAPPI method has the advantage over the ink flotation test of detecting the end point photometrically. The TAPPI method employs a mildly acidic aqueous dye solution as the penetrating component to permit optical detection of the liquid front as it moves through the paper sheet. The apparatus determines the time required for the reflectance of the sheet surface not in contact with the penetrant to drop to a predetermined (80 percent) percentage of its original reflectance.

The porosity values recited herein were measured with a Parker Print-Surf porosimeter, which records the volume of air per minute flowing through a sheet of paper. The edge raggedness values recited in the present application were measured using an Olympus microscope equipped with a camera capable of enlarging the recorded ink jet images. The edge raggedness value is the distance in millimeters for the intercolor bleed on a checkerboard pattern.

The printable laminateable labels of the present invention exhibit reduced curl upon being printed with aqueous inks. Generally, the term "curl" refers to the distance between the base line of the arc formed by recording sheet when viewed in cross-section across its width (or shorter dimension, for example 8.5 inches in an 8.5×11 inch sheet, as opposed to length, or longer dimension, for example 11 inches in an 8.5×11 inch sheet) and the midpoint of the arc. To measure curl, a sheet can be held with the thumb and forefinger in the middle of one of the long edges of the sheet, for example in the middle of one of the 11 inch edges in an 8.5×11 inch sheet, and the arc formed by the sheet can be matched against a pre-drawn standard template curve.

The lightfastness values of the ink jet images were measured in the Mark V Lightfastness Tester obtained from Microscal Company, London, England.

The gloss values recited herein were obtained on a 75° Glossmeter, Glossgard II from Pacific Scientific (Gardner/Neotec Instrument Division). The edge raggedness values recited in the present application were measured using an Olympus microscope equipped with a camera capable of enlarging the recorded ink jet images. The edge raggedness value is the distance in millimeters for the intercolor bleed on a checkerboard pattern.

The optical density measurements recited herein were obtained on a Pacific Spectrograph Color System. The system consists of two major components, an optical sensor and a data terminal. The optical sensor employs a 6 inch integrating sphere to provide diffuse illumination and 2 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters, and the entry of tristimulus values, and an alphanumeric keyboard for entry of product standard information. The print through value as characterized by the printing industry is Log base 10 (reflectance of a single sheet of unprinted paper against a black background/reflectance of the back side of a black printed area against a black background) measured at a wavelength of 560 nanometers.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Preparation of the Printable Laminateable Labels

Printable laminateable labels were prepared by the solvent extrusion process (single side each time initially) on a Faustel Coater using a one slot die, by providing for each a paper base sheet (roll form) with a thickness of 100 microns with a Hercules size value of 1,000 seconds and coating the diazo base sheet with a composition comprised of 20.0 parts by weight of the hydrophilic binder hydroxypropyl cellulose (Klucel Type E, available from Hercules Chemical Company), 10.0 parts by weight of the ink spreading agent poly(ethylene oxide), POLY OX WSRN-3000, available from Union Carbide Corporation, 25.0 parts by weight of the dye mordant quaternary acrylic copolymer latex polymethyl acrylate trimethyl ammonium chloride latex, HX42-1, available from Interpolymer Corporation, 3.0 parts by weight of the UV absorber poly[N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich Chemical Company), and 2.0 parts by weight of the antioxidant/antiozonant didodecyl 3,3'-thiodipropionate, 40.0 parts by weight of the filler colloidal silica, Syloid 74, available from W. R. Grace and Company, which composition was present in a concentration of 50 percent by weight in water. Subsequent to air drying at 100° C. and monitoring the difference in weight prior to and subsequent to coating, the dried paper base sheet rolls contained 0.5 gram, 6 microns in thickness, of the ink receiving layer. Rewinding the coated side of the paper base sheet (roll form) on to an empty core and using these rolls, the uncoated side of the paper base sheet were coated with the heat and adhesive component polyvinylmethylether #025, available from Scientific Polymer Products, from a concentration of 20 percent by weight in water. Subsequent to air drying at 100° C. and monitoring the difference in weight prior to and subsequent to coating, the dried paper base sheet rolls contained 0.4 gram, 5 microns in thickness, of the heat and adhesive coating. The formed heat and pressure sensitive adhesive coating was further covered for protection from sticking to unwanted surfaces by a peelable release paper, which release paper was comprised of a precoated 75 micron thick recycled Conservatree paper, with a coating of a release silicone wax F221, available from Wacker Silicones Corporation, from a 10 percent solution in isopropanol in a thickness of 5 microns. The printable laminateable labels were cut from this roll in sizes of 8.5×21.0 inch cut sheets.

Preparation of the Ink Jet Image on the Printable Laminateable Labels

The printable laminateable labels prepared were then incorporated into a Hewlett-Packard 500-C color ink jet printer containing inks of the following compositions, and wherein images were generated:

Cyan 15.785 percent by weight of sulfolane, 10.0 percent by weight of butyl carbitol, 2.0 percent by weight of ammonium bromide, 2.0 percent by weight of N-cyclohexylpyrollidinone obtained from Aldrich Chemical Company, 0.5 percent by weight of tris(hydroxymethyl) aminomethane obtained from Aldrich Chemical Company, 0.35 percent by weight of EDTA (ethylenediamine tetra acetic acid) obtained from Aldrich Chemical Company, 0.05 percent by weight of DOWICIL 150 biocide, obtained from Dow Chemical Company, Midland, Mich., 0.03 percent by weight of polyethylene oxide (molecular weight 18,500), obtained from Union Carbide Company), 35 percent by weight of Projet Cyan 1 dye, obtained from ICI, and 34.285 percent by weight of deionized water.

Magenta 15.785 percent by weight of sulfolane, 10.0 percent by weight of butyl carbitol, 2.0 percent by weight of ammonium bromide, 2.0 percent by weight of N-cyclohexylpyrollidinone obtained from Aldrich Chemical Company, 0.5 percent by weight of tris(hydroxymethyl) aminomethane obtained from Aldrich Chemical Company, 0.35 percent by weight of EDTA (ethylenediamine tetra acetic acid) obtained from Aldrich Chemical Company, 0.05 percent by weight of DOWICIL 150 biocide, obtained from Dow Chemical Company, Midland, Mich., 0.03 percent by weight of polyethylene oxide (molecular weight 18,500), obtained from Union Carbide Company), 25 percent by weight of Projet magenta 1T dye, obtained from ICI, 4.3 percent by weight of Acid Red 52 obtained from Tricon Colors, and 39.985 percent by weight of deionized water.

Yellow 15.785 percent by weight of sulfolane, 10.0 percent by weight of butyl carbitol, 2.0 percent by weight of ammonium bromide, 2.0 percent by weight of N-cyclohexylpyrollidinone obtained from Aldrich Chemical Company, 0.5 percent by weight of tris(hydroxymethyl) aminomethane obtained from Aldrich Chemical Company, 0.35 percent by weight of EDTA (ethylenediamine tetra acetic acid) obtained from Aldrich Chemical Company, 0.05 percent by weight of Dowicil 150 biocide, obtained from Dow Chemical Company, Midland, Mich., 0.03 percent by weight of polyethylene oxide (molecular weight 18,500), obtained from Union Carbide Company), 27.0 percent by weight of Projet yellow 1G dye, obtained from ICI, 20.0 percent by weight of Acid yellow 17 obtained from Tricon Colors, and 22.285 percent by weight of deionized water.

Lamination of Imaged Printable Laminateable Labels With the Spine and Covers of a Book, About 200 Pages After peeling the release papers of the two imaged labels, that is the name of the book, and the year it was published, and placing the nonimaged side of the labels in contact with the spine as well as cover of the book, these were laminated together at 50° C. and a pressure of 100 psi for 2 minutes. These images had optical density values of 2.05 (black), 1.37 (magenta), 1.60 (cyan), 0.90 (yellow) before washing and 1.85 (black), 1.30 (magenta), 1.55 (cyan) 0.90 (yellow) after washing at 50° C. for two minutes which translates into waterfastness values of 90 percent for the black ink, 97 percent for the (cyan) ink, 95 percent for the (magenta) ink, and 100 percent for the (yellow) ink. The optical density of these images after 72 hours in a Mark V Lightfastness Tester

[equivalent to three months of sunshine] was measured at 2.00 (black), 1.35 (magenta), 1.58 (cyan) and 0.88 (yellow), which translates into lightfastness greater than 97.5 percent for all inks. The high image quality obtained on these coated labels was evidenced by their low edge raggedness values of 0.12 millimeter (between black and yellow), 0.20 millimeter (between cyan and yellow), 0.18 millimeter (between magenta and yellow), and 0.30 millimeter (between magenta and cyan). The edge raggedness values for an uncoated Xerox 4024 paper printed with the same inks were much higher at 2.0 millimeters (between black and yellow), 0.95 millimeter (between cyan and yellow), 0.40 millimeter (between magenta and yellow), and 0.85 millimeter (between magenta and cyan).

EXAMPLE II

Preparation of Printable Laminateable Labels

Printable laminateable labels were prepared by the solvent extrusion process (single side each time initially) on a Faustel Coater using a one slot die by providing for each a TESLIN™ sheet (roll form), available from PPG Industries, with a thickness of 150 microns and coating the base sheet with a hydrophilic polymeric composition comprised of a blend of 30 parts by weight of diethylammonium chloride hydroxy ethyl cellulose, available as Celquat H-100, L-200, National Starch and Chemical Company, 30 parts by weight of ethylene oxide/propylene oxide/ethylene oxide triblock copolymer, Alkatronic EGE-31-1, available from Alkaril Chemicals, 3.0 parts by weight of the UV absorbing compound poly[N,N-bis(2,2,6,6-tetramethyl-4-piperidinyl)-1,6-hexanediamine-co-2,4-dichloro-6-morpholino-1,3,5-triazine] (Cyasorb UV-3346, #41,324-0, available from Aldrich Chemical Company) and 2 parts by weight of an antioxidant compound 2,6-ditert-butyl-4-(dimethylaminomethyl)phenol (Ethanox 703, #41,327-5, available from Aldrich Chemical Company), 35.0 parts by weight of the dye mordant quaternary acrylic copolymer polymethyl acrylate trimethyl ammonium chloride HX42-3, which composition was present in a concentration of 25 percent by weight in water. Subsequent to air drying at 100° C. and monitoring the difference in weight prior to and subsequent to coating, the dried TESLIN™ base sheet rolls contained 0.8 gram, 9 microns in thickness, of the ink receiving layer. Rewinding the coated side of the TESLIN™ base sheet (roll form) on to an empty core and using these rolls, the uncoated side of the TESLIN™ base sheet was coated with poly(2-ethylhexyl acrylate), #249, available from Scientific Polymer Products, from a concentration of 20 percent by weight in toluene. Subsequent to air drying at 100° C. and monitoring the difference in weight prior to and subsequent to coating, the dried TESLIN™ base sheet rolls contained 0.6 gram, 7 microns in thickness, of the heat and pressure sensitive adhesive coating. The heat and pressure sensitive coating was further covered and coated for protection from sticking to unwanted surfaces by a peelable release paper, which release paper is comprised of Conservatree precoated 75 micron thick recycled paper, with a release fluoropolymer 20 percent by weight dispersion in water, available as Zepel DR, from E. I. DuPont de Nemours and Company Incorporated, in a thickness of 5.0 microns. The printable laminateable labels were cut from this roll in sizes large enough to cover the spine, the front and the back cover of the book, such as 8.5×21.0 inch cut sheets.

Preparation of the Ink Jet Ink Images on the Printable Laminateable Labels

The printable laminateable labels prepared were incorporated into a Hewlett-Packard 500-C color ink jet printer containing the inks of Example I.

Images were generated having optical density values of 1.40 (cyan), 1.27 (magenta), 0.85 (yellow) and 2.05 (black).

Lamination of Imaged Printable Laminateable Labels with the Spine and Covers of the Book After peeling the release papers of the three imaged labels, a picture of a book author, title of the book, and the date of publication of the book, and placing the nonimaged side of the labels in contact with the spine as well as the front and the back cover of the book, these were laminated together at 50° C. and a pressure of 100 psi for 2 minutes. The laminated structures had no curl and no scuffing. These images had optical density values of 1.95 (black), 1.20 (magenta), 1.35 (cyan), 0.85 (yellow) after washing at 50° C. for two minutes, which translates into waterfastness values of 95 percent for the (black) ink, 96.5 percent for the (cyan) ink, 94.5 percent for the (magenta) ink, and 100 percent for the (yellow) ink. The optical density of these images after 72 hours in a Mark V Lightfastness Tester [equivalent to three months of sunshine] was measured at 2.00 (black), 1.25 (magenta), 1.38 (cyan) and 0.85 (yellow), which translated into lightfastness greater than 97.5 percent for all inks. The high image quality obtained on these coated labels was shown by their low edge raggedness values of 0.16 millimeter (between black and yellow), 0.23 millimeter (between cyan and yellow), 0.20 millimeter (between magenta and yellow), and 0.35 millimeter (between magenta and cyan). The edge raggedness values for an uncoated Xerox 4024 paper printed with same inks were, however, higher at 2.0 millimeters (between black and yellow), 0.95 millimeter (between cyan and yellow), 0.40 millimeter (between magenta and yellow), and 0.85 millimeter (between magenta and cyan).

EXAMPLE III

Preparation of Printable Xerographic Laminateable Labels

Printable laminateable labels were prepared by the solvent extrusion process (single side each time initially) on a Faustel Coater using a one slot die by providing for each an opaque MYLAR® base sheet (roll form) with a thickness of 100 microns and coating the base sheet with a blend of 50.0 parts by weight of the hydrophobic component vinyl chloride-vinyl acetate-vinyl alcohol terpolymer #428 available from Scientific Polymer Products, 40.0 parts by weight ethylene oxide/isoprene/ethylene oxide triblock copolymers, synthesized via anionic polymerization of isoprene with sodium naphthalene in tetrahydrofuran as solvent at −78° C., and then adding monomer ethylene oxide and polymerizing the reaction for three days, after which time the reaction is quenched with methanol, the ethylene oxide content in the aforementioned triblock copolymers being about 50 percent by weight, 3 parts by weight of UV absorbing compound 2-(4-benzoyl-3-hydroxyphenoxy)ethylacrylate (Cyasorb UV-416, #41,321-6, available from Aldrich Chemical Company), and 2 parts by weight of an antioxidant compound didodecyl 3,3'-thiodipropionate (Cyanox, LTDP, #D12,840-6, available from Aldrich Chemical Company), 4.5 parts by weight of the antistatic component (Alkasurf SS-L7DE, commercially available from Alkaril Chemicals) and 0.5 part by weight of colloidal silicas (Syloid 74, available from Grace Company), which composition was present in a concentration of 5.0 percent by weight in dichloromethane. Subsequent to air drying at 100° C. and monitoring the difference in weight prior to and subsequent to coating, the dried opaque MYLAR® base sheet rolls contained 0.25 gram, 3.5 microns in thickness, of the toner receiving layer. Rewinding the coated side of the opaque MYLAR® base sheet (roll form) on to an empty core and using these rolls, the uncoated side of the opaque MYLAR® base sheet were coated with polyisoprene #073, available from Scientific Polymer Products, present in a concentration of 5.0 percent by weight in toluene. Subsequent to air drying at 100° C. and monitoring the difference in weight prior to and subsequent to coating, the dried opaque MYLAR® base sheet rolls contained 0.5 gram, 6 microns in thickness, of the book spine and book cover compatible heat and pressure sensitive adhesive coating. The heat and pressure sensitive coating is further covered for protection from sticking to unwanted surfaces by a peelable release paper, which release paper is comprised of a precoated 75 micron thick recycled paper, such as Conservatree, with a release copolymer poly(dimethyl siloxane)-b-poly(propylene oxide)-b-poly (ethylene oxide) copolymer (Alkasil NEP 73-70, Alkaril Chemicals) in a thickness of 3.0 microns coated from a 5.0 percent by weight solution in toluene and dried at 100° C. The printable laminateable label were cut from this roll in sizes large enough to cover the spine, the front and the back cover of the book, such as 8.5×21.0 inch cut sheets.

Preparation of the Xerographic Image on Printable Laminateable Labels

Printable laminateable labels were fed into a Xerox 5760 digital color copier containing a solid toner of a polyester and a colored pigment, and images were obtained having optical density values of 1.20 (cyan), 1.15 (magenta), 0.85 (yellow) and 1.55 (black).

Lamination of Image on Opaque Mylar with the Spine and Covers of the Book

After peeling the release papers of the three imaged, that is the picture of the author of a book, the publication date of the book, and the title of the book, labels and placing the nonimaged side of the labels in contact with the spine as well as the front and the back cover of the book, these were laminated together at 50° C. and a pressure of 100 psi for 2 minutes. The laminated structures had no curl and no scuffing. These images were 100 percent waterfast when washed with water for 2 minutes at 50° C. and 100 percent lightfast for a period of 72 hours as determined by a Mark V Lightfastness Tester [equivalent to three months of sunshine] without any change in their optical density.

Other embodiments and modifications of the present invention may occur to those skilled in the art subsequent to a review of the information presented herein, these embodiments and modifications, as well as equivalents thereof, are also included within the scope of this invention.

What is claimed is:

1. Printable ink jet laminateable labels consisting essentially of (1) a substrate; (2) a first ink receiving coating on the front side of the substrate capable of absorbing an ink vehicle, and which receiving layer coating is comprised of (a) a hydrophilic binder polymer, (b) an ink spreading agent, (c) a dye mordant, (d) a lightfastness inducing agent or component, (e) an optional biocide, (f) an optional filler, and (h) an optional latex binder; (3) a second heat and pressure sensitive adhesive coating in contact with the back, or reverse of the front side of the substrate, and which adhesive is comprised of a polymer with a glass transition temperature of from between about a negative −100° C. to about 25° C.; and (4) a peelable release paper covering the adhesive coated side of the label, which release paper is coated with a release polymer, wherein the dye mordant agents of the first layer coating composition are selected from the group consisting of (1) ammonium quaternary salts, (2) phosphonium quaternary salts, (3) sulfonium quaternary salts, (4) thiazolium quaternary salt, (5) benzothiazolium quaternary salts, and (6) mixtures thereof.

2. A printable laminateable label according to claim 1 wherein the substrate is selected from the group consisting of (1) polyesters, (2) polyethylene naphthalates, (3) polycarbonates, (4) polysulfones, (5) polyether sulfones, (6) poly(arylene sulfones), (7) cellulose triacetate, (8) polyvinylchloride, (9) cellophane, (10) polyvinyl fluoride, (11) polypropylene, (12) polyimides, (13) diazo papers, and (14) coated photographic papers.

3. A printable laminateable label according to claim 1 wherein the hydrophilic polymeric binder is a polysaccharide selected from the group consisting of polysaccharides (1) starch, (2) cationic starch, (3) hydroxypropyl starch, (4) hydroxyethyl starch, (5) gelatin, (6) methyl cellulose, (7) benzyl cellulose, (8) phenyl cellulose, (9) hydroxyethyl cellulose, (10) hydroxypropyl cellulose, (11) ethyl hydroxyethyl cellulose, (12) hydroxyethyl methyl cellulose, (13) hydroxypropyl methyl cellulose, (14) hydroxy butylmethyl cellulose, (15) dihydroxypropyl cellulose, (16) hydroxypropyl hydroxyethyl cellulose, (17) chlorodeoxycellulose, (18) amino deoxycellulose, (19) diethylammonium chloride hydroxy ethyl cellulose, (20) hydroxypropyl trimethyl ammonium chloride hydroxyethyl cellulose, (21) DEAE cellulose, (22) carboxymethyl dextrans, (23) diethyl aminoethyl dextran, (24) amino dextran, (25) sodium carboxymethyl cellulose, (26) gum arabic, (27) carrageenan, (28) Karaya gum, (29) xanthan, (30) chitosan, (31) carboxymethyl hydroxypropyl guar, (32) cationic guar, (33) n-carboxymethyl chitin, (34) dimethyl ammonium hydrolyzed collagen protein, (35) agar-agar, (36) sodium cellulose sulfate, and (37) sodium carboxymethylhydroxyethyl cellulose.

4. A printable laminateable label according to claim 1 wherein the lightfastness inducing agent of the first layer contains a UV absorbing compound selected from the group consisting of (1) glycerol ρ-amino benzoate, (2) resorcinol mono benzoate, (3) octyl dimethyl amino benzoate, (4) hexadecyl 3,5-di-tert-butyl-4-hydroxy-benzoate, (5) octyl salicylate, (6) octyl methoxy cinnamate, (7) 4-allyloxy-2-hydroxybenzophenone, (8) 2-hydroxy-4-methoxy benzophenone, (9) 2,2'-dihydroxy-4,4'-dimethoxy benzophenone, (10) 2-hydroxy-4-(octyloxy)benzophenone, (11) 2-hydroxy-4-dodecyloxy benzophenone, (12) 2-(2'-hydroxy-5'-methylphenyl)benzotriazole, (13) 2-[2'-hydroxy-3,5-di-(1,1-dimethyl benzyl)phenyl]-2H-benzotriazole, (14) bis[2-hydroxy-5-tert-octyl-3-(benzotriazol-2-yl)phenyl]methane, (15) 2-(3',5'-di-tert-butyl-2'-hydroxyphenyl)-5-chlorobenzotriazole, (16) 2-(4-benzoyl-3-hydroxyphenoxy)ethylacrylate, (17) poly[2-(4-benzoyl-3-hydroxyphenoxy)ethylacrylate], (18) N-(ρ-ethoxycarbonyl phenyl)-N'-ethyl-N'-phenyl formadine, (19) 1,1-(1,2-ethane-diyl) bis(3,3,5,5-tetramethyl piperazinone), (20) tris(3,5-di-tert-butyl-4-hydroxybenzyl)isocyanurate, (21) nickel bis(o-ethyl(3,5-di-tert-butyl-4-hydroxybenzyl) phosphonate, (22) [2,2,6,6-tetramethyl-4-piperidinyl]-1,2,3,4-butane tetracarboxylate, (23) [2,2,6,6-tetramethyl-4-piperidinyl/β,β,β',β'-tetramethyl-3,9-(2,4,8,10-tetraoxospiro (5,5) undecane)diethyl]-1,2,3,4-butane tetracarboxylate, (24) [1,2,2,6,6-pentamethyl-4-piperidinyl/β,β,β',β'-tetramethyl-3,9-(2,4,8,10-tetraoxospiro (5,5) undecane) diethyl]-1,2,3,4-butane tetracarboxylate, (25) 2-dodecyl-N-(2,2,6,6-tetramethyl-4-piperidinyl) succinimide, (26)

2-dodecyl-N-(1,2,2,6,6-pentamethyl-4-piperidinyl) succinimide, (27) N-(1-acetyl-2,2,6,6-tetramethyl-4-piperidinyl)-2-dodecyl succinimide, (28) tetra sodium N-(1,2-dicarboxyethyl)-N-octadecyl sulfosuccinamate, (29) nickel dibutyldithiocarbamate, (30) poly(4-hydroxy-2,2,6,6-tetramethyl-1-piperidine ethanol/dimethyl succinic acid), (31) poly(3,5-di-tert-butyl-4-hydroxy hydrocinnamic acid ester/1,3,5-tris(2-hydroxyethyl)-5-triazine-2,4,6(1H,3H,5H)-trione, (32) poly[N,N-bis(2,2,6,6-tetramethyl-4-piperidinyl)-1,6-hexanediamine-co-2,4-dichloro-6-morpholino-1,3,5-triazine], (33) 1-[N-[poly(3-allyloxy-2-hydroxypropyl)-2-aminoethyl]-2-imidazolidinone, (34) poly(2-ethyl-2-oxazoline), and mixtures thereof.

5. A printable laminateable label according to claim 1 wherein the filler components of the first layer coating composition are selected from the group consisting of (1) microspheres of sodium borosilicate glass, (2) microspheres of soda lime glass, (3) microspheres of phenolic polymers, (4) vinylidene chloride-acrylonitrile microspheres, (5) hollow composite microspheres of polyvinylidene chloride/acrylonitrile copolymer shell, 15 percent by weight, and calcium carbonate, 85 percent by weight, (6) stearate coated calcium carbonate, (7) sodium metasilicate anhydrous, (8) sodium metasilicate pentahydrate, (9) organophilic montmorillonitrile clay, (10) magnesium aluminum silicate, (11) magnesium carbonate, (12) magnesium oxide, (13) zirconium oxide, (14) colloidal silicas, (15) titanium dioxide, (16) hydrated alumina, (17) barium sulfate, (18) calcium carbonate, (19) high brightness clays, (20) calcium silicate, (21) blends of calcium fluoride and silica, (22) zinc oxide, (23) blends of zinc sulfide with barium sulfate, (24) barium titanate, (25) brightener fluorescent pigments of Coumarin derivatives, (26) fluorescent pigments of oxazole derivatives, (27) antimony oxide; and mixtures thereof.

6. A printable laminateable label according to claim 1 wherein the total thickness of the first coating layer is from about 0.1 to about 25 microns.

7. A printable laminateable label according to claim 1 wherein for the first layer coating the binder is present in amounts of from about 10 parts by weight to about 40 parts by weight, the ink spreading agent is present in an amount of from about 40 parts by weight to about 4 parts by weight, the dye mordant is present in an amount of from about 30 parts by weight to about 3 parts by weight, the lightfastness inducing agents are present in amounts of from about 10 parts by weight to about 2 parts by weight, the filler is present in amounts of from about 7 parts by weight to about 50 parts by weight, and the biocide compound is present in amounts of from about 3 parts by weight to about 1 part by weight.

8. A printable laminateable label according to claim 1 wherein the polymeric binder of the second layer having a glass transition temperature of about −100° C. to about 25° C. is a solvent soluble binder selected from the group consisting of (1) poly(2-hydroxyethylacrylate), (2) poly(hydroxypropylacrylate), (3) poly(methyl acrylate), (4) poly(ethyl acrylate), (5) poly(n-propyl acrylate), (6) poly(isopropyl acrylate), (7) poly(n-butyl acrylate), (8) poly(tert-butyl acrylate), (9) poly(2-methoxy ethyl acrylate), (10) poly(benzyl acrylate), (11) poly(n-hexyl acrylate), (12) poly(2-ethylhexyl acrylate), (13) poly(octyl acrylate), (14) poly(isooctylacrylate), (15) poly(decylacrylate), (16) poly(isodecyl acrylate), (17) poly(lauryl acrylate), (18) poly(cyclohexyl acrylate), (19) poly(octadecyl acrylate), (20) poly(n-hexyl methacrylate), (21) poly(2-ethylhexyl methacrylate), (22) poly(n-decyl methacrylate), (23) poly(isodecyl methacrylate), (24) poly(lauryl methacrylate), (25) poly(octadecyl methacrylate), (26) polyethylene (27) polypropylene, (28) poly(1-butene), (29) poly(isobutylene), (30) ethylene-propylene copolymer, (31) ethylene-ethylacrylate copolymer, (32) isobutylene-co-isoprene copolymer, (33) ethylene-propylene-diene terpolymer, (34) polyisoprene, (35) polychloroprene (36) polybutadiene, (37) polybutadiene phenyl terminated, (38) polybutadienedicarboxy terminated, (39) polyvinylisobutylether, and (40) octadecene-1-maleic anhydride copolymer.

9. A printable laminateable label according to claim 1 wherein the thickness of the second coating layer is from about 0.1 to about 25 microns.

10. A printable laminateable label according to claim 1 wherein the thickness of the release coating layer is from about 0.1 to about 25 microns.

11. A printable laminateable label according to claim 1 wherein said label is selected for paper, cloth, book surfaces, or magazines.

12. A printable laminateable label according to claim 1 wherein said release paper is removed from the label prior to affixing the printed label to a surface by the application of heat and pressure.

13. A printable laminateable label according to claim 1 wherein said release paper is removed from the label prior to affixing the printed label to the spines and covers of books and magazines by the application of heat and pressure.

14. A printable laminateable label according to claim 1 wherein the lightfastness inducing agent or component is comprised of a mixture of a UV absorber component, an antioxidant component, and an antiozoant component.

* * * * *